US008371429B2

(12) United States Patent
Hamasaki

(10) Patent No.: US 8,371,429 B2
(45) Date of Patent: Feb. 12, 2013

(54) PAPER SHEET RECOGNITION APPARATUS AND METHOD

(75) Inventor: Hiroki Hamasaki, Hyogo (JP)

(73) Assignee: Glory Ltd., Himeji-shi (JP)

( * ) Notice: Subject to any disclaimer, the term of this patent is extended or adjusted under 35 U.S.C. 154(b) by 265 days.

(21) Appl. No.: 12/415,607

(22) Filed: Mar. 31, 2009

(65) Prior Publication Data

US 2009/0183967 A1 Jul. 23, 2009

Related U.S. Application Data

(63) Continuation-in-part of application No. PCT/JP2006/322118, filed on Nov. 6, 2006.

(51) Int. Cl.
*G07F 7/04* (2006.01)

(52) U.S. Cl. ..... 194/207; 194/206

(58) Field of Classification Search ..... 194/207, 194/205, 302; 250/559.01, 559.04, 559.05, 250/559.06, 559.07; 235/379; 209/534; 382/135, 137, 138, 139, 140
See application file for complete search history.

(56) References Cited

U.S. PATENT DOCUMENTS

| | | | | |
|---|---|---|---|---|
| 4,825,051 | A * | 4/1989 | Kawai et al. | 705/43 |
| 6,621,919 | B2 * | 9/2003 | Mennie et al. | 382/135 |
| 7,552,864 | B2 | 6/2009 | Weilacher et al. | |
| 2003/0202690 | A1 * | 10/2003 | Jones et al. | 382/139 |
| 2004/0205025 | A1 | 10/2004 | Takeuchi et al. | |
| 2005/0011721 | A1 * | 1/2005 | Armanini et al. | 194/207 |
| 2008/0283451 | A1 | 11/2008 | Holl et al. | |
| 2009/0242627 | A1 | 10/2009 | Reinisch et al. | |
| 2010/0021634 | A1 * | 1/2010 | Kodas et al. | 427/256 |
| 2011/0255767 | A1 * | 10/2011 | Jenrick et al. | 382/135 |

FOREIGN PATENT DOCUMENTS

| | | | |
|---|---|---|---|
| DE | 10029051 | A1 | 12/2001 |
| EP | 1160737 | A1 | 5/2001 |
| EP | 1467327 | A2 | 10/2004 |
| JP | 9-245218 | A | 9/1997 |
| JP | 2004-164458 | A | 6/2004 |
| JP | 2004-310594 | A | 11/2004 |
| JP | 2006-120180 | A | 5/2006 |
| WO | WO 2005/114596 | A1 | 1/2005 |

OTHER PUBLICATIONS

European Central Bank, Recycling of Euro Banknotes: Framework For The Detection Of Counterfeits and Fitness Sorting By Credit Institutions And Other Professional Cash Handlers, Jan. 2005, pp. 1-10.

* cited by examiner

*Primary Examiner* — Mark Beauchaine
(74) *Attorney, Agent, or Firm* — Foley & Lardner LLP

(57) ABSTRACT

A paper sheet recognition apparatus includes a sensor that measures feature amounts of a paper sheet; a recognition unit that recognizes whether the paper sheet is genuine or counterfeit, and fit or unfit, based on the feature amount; a memory unit that stores therein a plurality of pieces of different category classification pattern information prepared for each category for classifying the paper sheets into a plurality of categories, which is obtained by combining the feature amounts; and a category determining unit that determines a category of the recognized paper sheet using a recognition result in the recognition unit and the category classification pattern information.

18 Claims, 22 Drawing Sheets

FIG.3A

| | COUNTRY A | COUNTRY B | COUNTRY C | COUNTRY D | ··· |
|---|---|---|---|---|---|
| FACTOR 1 | ○ | ○ | ○ | ○ | ··· |
| FACTOR 2 | ○ | ○ | ○ | ○ | ··· |
| FACTOR 3 | ○ | ○ | × | × | ··· |
| FACTOR 4 | × | × | ○ | ○ | ··· |
| · | · | · | · | · | ··· |
| FACTOR x | ○ | ○ | ○ | ○ | ··· |
| CATEGORY DETERMINATION | 1 | 2 | 2 | 1 | ··· |

FIG.3B

| | COUNTRY A | COUNTRY B | COUNTRY C | COUNTRY D | ··· |
|---|---|---|---|---|---|
| SUSFACTOR 1 | △ | △ | △ | △ | ··· |
| SUSFACTOR 2 | ○ | ○ | △ | △ | ··· |
| SUSFACTOR 3 | ○ | ○ | ○ | ○ | ··· |
| SUSFACTOR 4 | ○ | ○ | ○ | ○ | ··· |
| · | · | · | · | · | ··· |
| SUSFACTOR y | ○ | ○ | ○ | ○ | ··· |
| CATEGORY DETERMINATION | 2 | 3 | 3 | 2 | ··· |

FIG.3C

| | COUNTRY A | COUNTRY B | COUNTRY C | COUNTRY D | ··· |
|---|---|---|---|---|---|
| UNFITFACTOR 1 | × | × | × | × | ··· |
| UNFITFACTOR 2 | ○ | ○ | × | × | ··· |
| UNFITFACTOR 3 | ○ | ○ | ○ | ○ | ··· |
| UNFITFACTOR 4 | ○ | ○ | ○ | ○ | ··· |
| · | · | · | · | · | ··· |
| UNFITFACTOR y | ○ | ○ | ○ | ○ | ··· |
| CATEGORY DETERMINATION | 4a | 4b | 4b | 4a | ··· |

FIG.6

1 TRANSACTION INFORMATION

| CONTENTS | DETAILED CONTENT |
|---|---|
| APPARATUS NUMBER | |
| PROCESSING NUMBER | |
| PROCESSING STARTING DATE | YEAR, MONTH, DATE, HOUR, MINUTE, SECOND |
| PROCESSING FINISHING DATE | YEAR, MONTH, DATE, HOUR, MINUTE, SECOND |
| CUSTOMER INFORMATION | ACCOUNT NUMBER, FINGERPRINT INFORMATION AND THE LIKE |
| COUNTING INFORMATION | NUMBER OF BILLS PER DENOMINATION, AMOUNT, TOTAL NUMBER OF BILLS, TOTAL AMOUNT AND THE LIKE |
| BILL INFORMATION | BILL INFORMATION FOR PROCESSED NUMBER |
| BILL INFORMATION | BILL INFORMATION FOR PROCESSED NUMBER |
| ..... | ..... |
| BILL INFORMATION | BILL INFORMATION FOR PROCESSED NUMBER |

PAPER SHEET RECOGNITION APPARATUS AND METHOD

CONTINUATION APPLICATION VER.

This application is a continuation-in-part application of PCT international application Ser. No. PCT/JP2006/322118 filed on Nov. 6, 2006 which designates the United States, incorporated herein by reference, the entire contents of which are incorporated herein by reference.

FIELD

The present invention relates to a paper sheet recognition apparatus and a paper sheet recognition method for performing recognition of a type or the like and category classification of paper sheets, and, more particularly to a paper sheet recognition apparatus and a paper sheet recognition method with general-purpose properties.

BACKGROUND

Conventionally, at the time of depositing money using a deposit machine that performs credit transaction of bills at banking institutions, the deposited bills are recognized and classified into four categories of genuine bills determined to be authentic (including fit and unfit bills), counterfeit bills determined to be unauthentic, suspect bills with uncertain authenticity which cannot be determined as genuine bills, and rejected bills due to overlapping each other or skew. In addition, there has been a process that, when a bill is recognized as any one of the counterfeit bill, the suspect bill, and the rejected bill other than the genuine bill, the bill is returned to a customer as an unacceptable bill.

It is a crime to use counterfeit bills, and when the counterfeit bill or the suspect bill is used, it is necessary to check carefully whether it is a counterfeit bill. Further, the counterfeit and suspect bills are important evidence that can be used as an exhibit of a criminal act.

Therefore, as a technique that can confirm the counterfeit bill and ensure the evidence of using the counterfeit bill, a paper sheet processing apparatus has been proposed, which includes a user specifying unit that specifies a user, an inlet unit in which paper sheets to be deposited are placed, a feeding unit that sequentially feeds in the paper sheets placed in the loading unit, a recognition unit that recognizes the paper sheets fed by the feeding unit with classification of the paper sheets into four categories of genuine bills, counterfeit bills, suspect bills, and rejected bills, an escrow unit that temporarily holds the genuine bills, counterfeit bills, and the suspect bills other than the rejected bills identified by the recognition unit, a plurality of storage units that store the temporarily held bills in the escrow unit, and a rejection unit that stacks therein the paper sheets determined as the rejected bills for returning them to a customer (for example, see Japanese Patent Application Laid-open No. 2004-310594).

Further, there has been a bill processing apparatus that has a plurality of bills determination parameters so that denominations to be handled and countries can be easily changed (for example, see Japanese Patent Application Laid-open No. 2004-164458).

Specifically, the bill processing apparatus includes a database that can be referred to by a plurality of country codes and denomination codes associated with the country codes, and stores the bill determination parameters for each country code and denomination code. The bill determination parameters include a denomination determination parameter, an authenticity determination parameter, a fitness determination parameter or the like. By changing the country code and the denomination code, it can be easy to perform setting change to a country different from the country set in the bill processing apparatus and to a different denomination type.

The bill processing apparatus also stores an individual user parameter, which does not depend on the country code or denomination code, and indicates a fitness detection level and an authenticity determination level according to preference of the user. For example, a set threshold for the fitness determination can be changed based on the individual user parameter to reduce the amounts of bills determined as an unfit bill. By use of the individual user parameterm, the bill processing apparatus can perform bill determination according to the situations of the user's circumstances due to the country and environment where the apparatus is installed.

In the conventional paper sheet processing apparatus described above, the recognized bills are classified into four categories of the genuine bills, the counterfeit bills, the suspect bills, and the rejected bills, to be returned to the customer or brought into the processing apparatus, associated with each categorization according to a recognition result, and various transaction information are recorded.

As for Euro bills, category classification is performed based on sample media held in the national central bank (NCB) of each country, separately from the category classification set in the European Central Bank (ECB).

However, in the conventional paper sheet processing apparatus, only single type of category classification has been possible, and thus the evaluation of the sample media is performed at the central bank for each country where the paper sheet processing apparatus is installed, to perform category classification by a determination of the NCB each time, and tuning is performed for each country, to which the paper sheet processing apparatus is sold, to change firm.

That is, the final determination of category classification is performed at the central bank of each country. Because category criteria and determination logic are different for each country, with the conventional paper sheet processing apparatus described above, a program needs to be managed by allocating one apparatus for each country.

Further, in the conventional bill processing apparatus described above that can easily set the country and denomination type, the merit of its functions are not useful. That is, in an area where plural countries uses the same bills as in Europe using Euro bills, the denomination type does not need to be changed, and there is no point in changing the setting of the country. Therefore, to handle the difference in category classification criteria for each country in each denomination, the individual user parameter needs to be reset when the country is changed.

SUMMARY

It is an object of the present invention to at least partially solve the problems in the conventional technology.

A paper sheet recognition apparatus according to an aspect of the invention includes a sensor that measures feature amounts of a paper sheet; a recognition unit that recognizes whether the paper sheet is genuine or counterfeit, and fit or unfit, based on the feature amount; a memory unit that stores therein a plurality of pieces of different category classification pattern information prepared for each category for classifying the paper sheets into a plurality of categories, which is obtained by combining the feature amounts; and a category determining unit that determines a category of the recognized paper sheet using a recognition result in the recognition unit and the category classification pattern information.

A bill processing apparatus according to another aspect of the invention includes a sensor that measures a plurality of feature amounts of a bill; a recognition unit that recognizes denomination of the bill based on the feature amount; a memory unit that stores therein a plurality of pieces of category classification pattern information for classifying the bills into a plurality of categories, which is obtained by combining the feature amounts; and a category determining unit that determines a category of the bill using the category classification pattern information based on the feature amounts.

The above and other objects, features, advantages and technical and industrial significance of this invention will be better understood by reading the following detailed description of presently preferred embodiments of the invention, when considered in connection with the accompanying drawings.

BRIEF DESCRIPTION OF DRAWINGS

FIG. 3A is one example of a category classification table referred to at the time of categorizing a bill as an unrecognizable bill in the bill depositing and dispensing machine according to the first embodiment of the present invention;

FIG. 3B is one example of a category classification table referred to at the time of categorizing a bill as a counterfeit bill in the bill depositing and dispensing machine according to the first embodiment of the present invention;

FIG. 3C is one example of a category classification table referred to at the time of categorizing a bill identified as a genuine bill to a fit bill or unfit bill in the bill depositing and dispensing machine according to the first embodiment of the present invention;

FIG. 6 is one example of transaction information in the bill depositing and dispensing machine according to the first embodiment of the present invention;

DESCRIPTION OF EMBODIMENTS

Preferred embodiments of a paper sheet recognition apparatus and a paper sheet recognition method according to the present invention will be explained below in detail with reference to the accompanying drawings. A case that a bill is a paper sheet as the identifying subject is explained below. The present invention is not limited to the following descriptions, and various modifications can be made without departing from the scope of the invention.

First Embodiment

Figure 1:
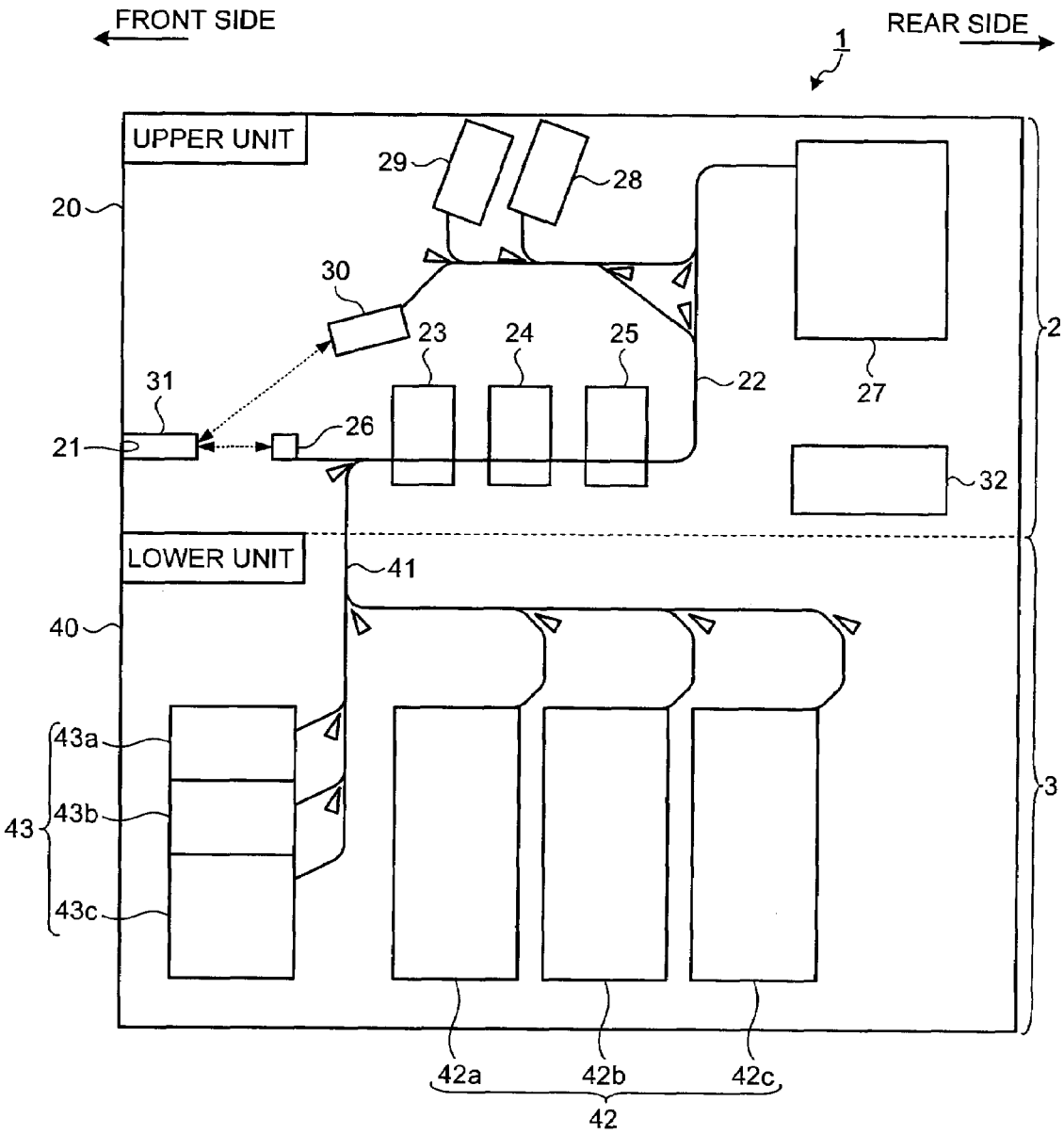
FIG. 1 depicts a schematic configuration of a bill depositing and dispensing machine according to a first embodiment of the present invention.

FIG. 1 depicts a schematic configuration of a bill depositing and dispensing machine according to a first embodiment. A bill depositing and dispensing machine 1 according to the present embodiment includes a function as the paper sheet recognition apparatus according to the present invention. The bill depositing and dispensing machine 1 is mainly installed at banking institutions such as banks and post offices, can perform deposit processing and withdrawal processing of bills as the paper sheets, and uses deposited bills as bills to be withdrawn cyclically. The bill depositing and dispensing machine 1 according to the present embodiment includes, as shown in FIG. 1, an upper unit 2 and a lower unit 3. A transaction port 21 is provided on the front side of a housing 20 of the upper unit 2. The transaction port 21 opens to inside and outside of the housing 20, and performs delivery of the bills between a user and the depositing and dispensing. The transaction port 21 can be opened or closed by a shutter.

A transport path 22 is provided inside the housing 20 of the upper unit 2. The transport path 22 defines a transport region extending in a loop such that it starts from one end directed to the transaction port 21 toward a rear side, then extends toward an upper side at the rear, and returns from the upper side to the other end directed to the transaction port 21, so that the bills are transported along an extending direction of the transport region.

A sensor unit 23, a serial number reader 24, and a recognition/determination unit 25 are formed on a part of the transport path 22.

The sensor unit 23 includes a plurality of types of sensors such as an optical sensor and a magnetic sensor to detect a feature amount indicating a shape of the bill, a feature amount indicating a magnetic content included in the bill, and a feature amount indicating a quantity or wavelength of light transmitted through or reflected by the bill, as various security information (a feature amount in a specific part of the bill) such as the shape or image of the bill, and magnetism or a magnetic thread applied to the bill to prevent counterfeiting.

The shape or image of the bill can be obtained by including, for example, a line sensor in the sensor unit 23. The security information can be detected by the magnetic sensor that measures the magnetism of a toner, a thickness sensor that measures thickness of the bill, an infrared sensor, or a UV sensor.

The serial number reader 24 is provided on a subsequent stage of the sensor unit 23 in the transport path 22, and reads a serial number written on the bill.

The recognition/determination unit 25 is a processor provided on a subsequent stage of the serial number reader 24 in the transport path 22, which recognizes whether the bill is genuine or counterfeit, and fit or unfit, based on a plurality of pieces of recognition security information of the bill detected by the sensors in the sensor unit 23 (the feature amount in a specific part of the bill) and a category classification table described later and determines category classification.

A plurality of gateways for bringing in and out the bills is formed on an outer circumstance of the loop of the transport path 22. A feeding unit 26, an escrow unit 27, a first collecting unit 28, a second collecting unit 29, and a temporary stacking unit 30 arranged on the outer circumference of the transport path 22 are connected to the gateways. In the looped transport path 22, the feeding unit 26 is arranged at one end, the escrow unit 27, the first collecting unit 28, and the second collecting unit 29 are arranged in this order toward the other end, and the temporary stacking unit 30 is arranged at the other end.

The feeding unit 26 feeds the bills to the transport path 22 one by one. The escrow unit 27 takes in the bills transported to the transport path 22 one by one to hold the bill as required, and feeds the hold bills to the transport path 22 and holds the bills as required, based on a category determination result in the recognition/determination unit 25. The escrow unit 27 is preferably, for example, a roll type capable of sequentially taking out the bills in reverse order of holding the bills, however, a stacking type can be also used. The first collecting unit 28 and the second collecting unit 29 take in the bills transported to the transport path 22 and collect the bills as required.

The temporary stacking unit 30 stacks therein the bills output from the transaction port 21. Provided between the transaction port 21 and the feeding unit 26, and between the transaction port 21 and the temporary stacking unit 30 is a receiving/ejecting mechanism 31 for receiving the bill via the transaction port 21 to carry the bill from the feeding unit 26 to the transport path 22, or paying the bill stacked in the temporary stacking unit 30 via the transaction port 21.

The escrow 27 has a function of distributing the bill according to an instruction of a controller 32 described later at the time of discharging the temporarily held bill, such that it distributes the bill to the temporary stacking unit 30 when the bill is to be returned and distributes to the lower unit 3 when the bill is to be stored.

The controller 32 that controls the entire bill depositing and dispensing machine 1 is provided in the upper unit 2.

Bill information to be output as a result of being recognized by the recognition/determination unit 25, the serial number reader 24, and the sensor unit 23 includes, for example, information described below for each sheet.

(a) Bill ID number: consecutive number counted in one transaction (b) Information related to recognition result: specific attribute of bill obtained as a result of recognition of the bill Category code (recognition result obtained by comprehensively determining the recognition result for each sensor), country code, denomination code, direction (front and back) code, serial number, and denomination determination level (criterion)

(c) Information related to sensor data: recognition result for each sensor provided in respective positions (d) Bill image information as detailed data of the bill On the other hand, a transport path 41 for transporting the bills is provided in a housing 40 of the lower unit 3. The transport path 41 defines a transport region extending from one end connected to a part between the feeding unit 26 and the sensor unit 23 on the transport path 22 in the upper unit 2 to have a plurality of ends branched toward the lower side in the housing 40 and transports the bills along the extending direction of the transport region. A bill storage (storage unit) 42 and a bill vault 43 are connected to the respective ends branched from the transport path 41.

The bill storage 42 stores therein a plurality of bills for withdrawal or deposited bills. The bill storage 42 stores therein the same denomination bills, and includes a plurality of bill storages provided in the housing 40, corresponding to respective denominations. In the present embodiment, the bill storage 42 includes three bill storages 42*a*, 42*b*, and 42*c*. The bill vault 43 includes a plurality of bill vaults provided in the housing 40 to store various bills such as an unclear bill with uncertain authenticity or damaged and stained bill, which are not used as the bills for withdrawal. In the present embodiment, the bill vault 43 includes three bill vaults 43*a*, 43*b*, and 43*c*. The number of bill storages and bill vaults may be determined as needed.

Figure 2:
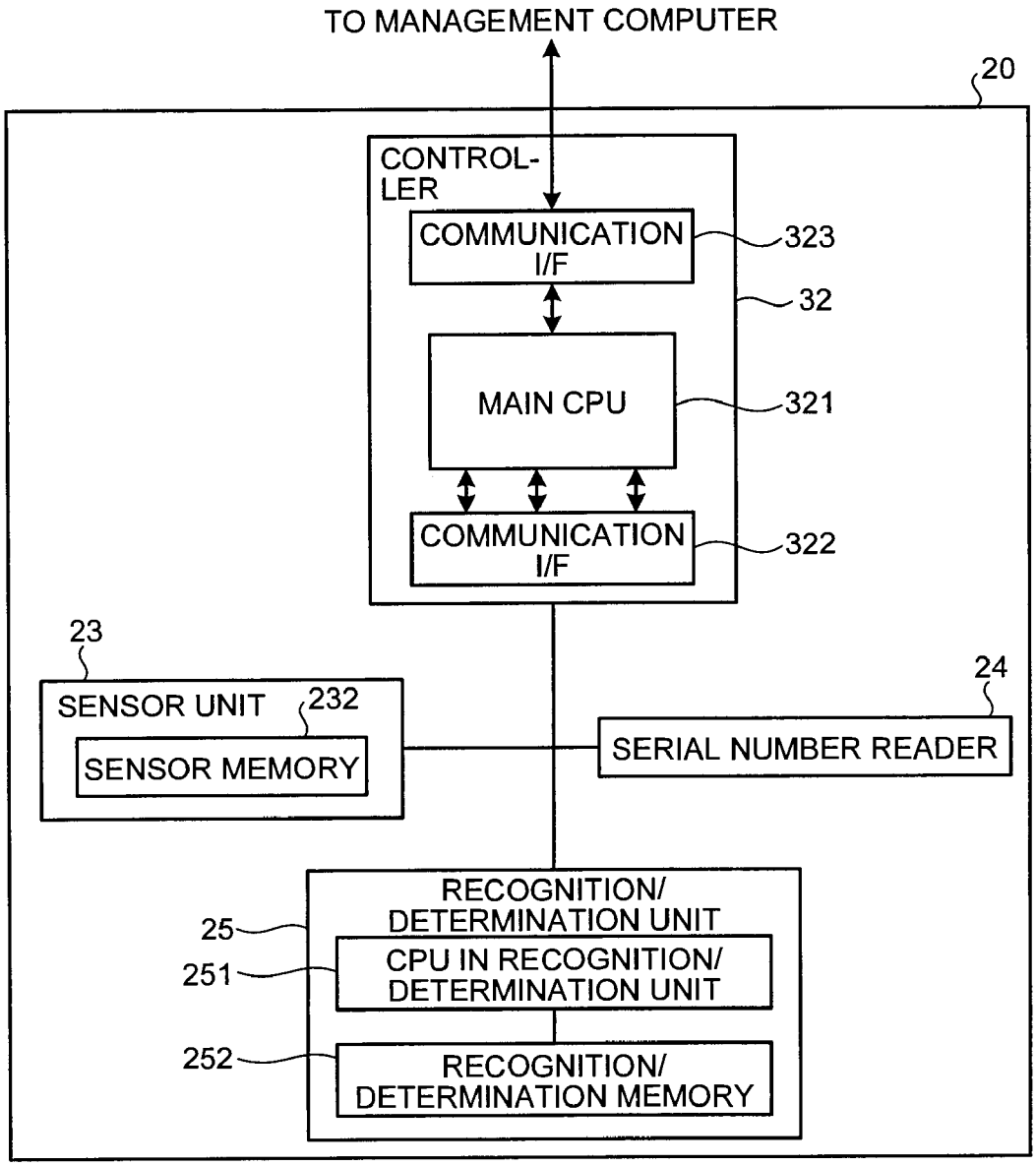
FIG. 2 is a block diagram for explaining a control system and transmission of information in the bill depositing and dispensing machine according to the first embodiment of the present invention.

FIG. 2 is a block diagram for explaining a control system and transmission of information in the bill depositing and dispensing machine 1. A main CPU 321 that controls the entire apparatus and a communication interface 322 are provided in the controller 32 of the upper unit 2. A microcomputer that can perform relatively high speed processing is used for the main CPU 321.

A CPU 251 is provided in the recognition/determination unit 25, and bears a part of the control of a functional unit and a data transfer function. The CPU 251 in the recognition/determination unit is a one-chip microcomputer; however, a lower speed and cheaper microcomputer than the main CPU 321 is sufficient.

The CPU 251 in the recognition/determination unit not only controls the recognition/determination unit 25, but also transfers required data between the main CPU 321 and the CPU 251. In this case, the CPU 251 in the recognition/determination unit transfers recognition/determination data to the main CPU 321 via the communication interface 322.

The sensor unit 23 includes a sensor memory 232, and a plurality of pieces of sensor information (recognition security information) detected by the sensors is transmitted to the main CPU 321 and is also stored in the sensor memory 232 in the sensor unit 23.

The CPU 251 in the recognition/determination unit recognizes whether the bill is genuine or counterfeit, and fit or unfit, based on the pieces of recognition security information (the feature amount in a specific part of the bill) detected by the sensors in the sensor unit 23 to generate recognition result information with regard to the respective pieces of recognition security information (the feature amount in a specific part of the bill). The recognition result information is stored in an recognition/determination memory 252 in the recognition/determination unit 25. Reference data for recognizing whether the bill is genuine or counterfeit, and fit or unfit, based on the respective pieces of recognition security information (the feature amount in a specific part of the bill) is stored in the recognition/determination memory 252.

The recognition/determination memory 252 holds reference data (combination data of country specifying information, recognition result information, and category) for individual category classification in each country based on the country specifying information and the recognition result information, as a category classification table. The category classification table is respectively provided for each of five categories of genuine and fit bill (category 1), genuine and unfit bill (category 2), suspect bill that cannot be clearly determined as a genuine bill (category 3), counterfeit bill which is clearly different from a genuine bill and suspected as a counterfeit bill (category 4), and unrecognizable bill which is not a bill or cannot be recognized as a bill (rejected bill, category 5). The CPU 251 in the recognition/determination unit refers to the category classification table to categorize the bill.

The information read by the serial number reader 24 is transmitted to the main CPU 321 via the communication interface 322.

FIG. 3A is one example of the category classification table referred to at the time of, for example, categorizing the bill as the unrecognizable bill. As shown in FIG. 3A, the country specifying information (country A, country B, country C, country D, . . . ), criteria specific to unrecognizable bill category classification in each country for respective pieces of recognition result information (factor 1, factor 2, factor 3, factor 4, . . . ), and category determination information are combined and stored in the category classification table. The criteria (factors) for the recognition result information include, for example, factors such as monochrome dummy bill having the same shape, monochrome copied bill without magnetism, and color copied bill with toner magnetism.

FIG. 3B is one example of the category classification table referred to at the time of, for example, categorizing the bill as the counterfeit bill. As shown in FIG. 3B, the country specifying information (country A, country B, country C, country D, . . . ), the criteria specific to the counterfeit bill category classification in each country for respective pieces of recognition result information (susfactor 1, susfactor 2, susfactor 3, susfactor 4, . . . ), and the category determination information are combined and stored in the category classification table. The criteria (susfactors) for the recognition result information include factors such as magnetic-thread magnetic bit pattern, serial-number magnetic component on one side of backside (the magnetic content included in the serial-number printed portion, the portrait portion, and the amount-printed portion), and attenuation due to an ink having absorbed IR (infrared rays) transmitted through or reflected by the bill.

FIG. 3C is one example of the category classification table referred to at the time of, for example, categorizing the bill recognized as, for example, the genuine bill to the fit bill or the unfit bill. As shown in FIG. 3C, the country specifying information (country A, country B, country C, country D, . . . ), the criteria specific to the fit and unfit bill category classification in each country for respective pieces of recognition result information (unfitfactor 1, unfitfactor 2, unfitfactor 3, unfitfactor 4, . . . ), and the category determination information are combined and stored in the category classification table. The criteria (unfitfactors) for the recognition result information include factors such as a scribbled portion, a missing part amount, a corner folding amount, and detection of taping.

Denotation "1" in the category determination column in FIGS. 3A to 3C denotes the "unrecognizable bill (rejected bill), denotation "2" denotes the "counterfeit bill", denotation "3" denotes the "suspect bill", denotation "4*a*" denotes the "genuine and fit bill", and denotation "4*b*" denotes the "genuine and unfit bill".

The category classification table can be edited by the control from a management computer, or by an electrically connected electronic terminal (general purpose computer or the like), or an input unit (not shown) included in the bill depositing and dispensing machine 1.

Because such a category classification table is provided, the criteria for category determination can be promptly changed only by specifying the country based on the country specifying information, and the category determination can be easily performed based on the individual criteria of each country. Because the category determination can be easily performed based on the different criteria for each country only by specifying the country based on the country specifying information, the category determination based on the different criteria for each country can be supported promptly, easily, and flexibly.

In the category classification table, the criteria for the respective pieces of recognition result information can be freely added, changed, or deleted. Accordingly, even when the category determination criteria are changed, a new category determination can be easily supported only by changing the category classification table. In the change of the criteria for the recognition result information, the criteria relating to whether the bill is fit or unfit can be freely changed, however, because the change of the criteria relating to whether the bill is genuine or counterfeit has a major effect, it is necessary to be careful.

Further, by adding or changing the information in the category classification table, the category determination criteria of a new country can be easily added, without requiring individual development of a recognition apparatus exclusively for the new country. Therefore, even if the category determination criteria are changed or use thereof in the new country is desired, adaptation is possible only by adding or changing the information in the category classification table, thereby enabling to reduce the total cost.

Returning to the explanation of FIG. 2, the main CPU 321 is connected to a transmission system via a communication interface 323, through which data for identifying an unauthentic bill and a processing record are transmitted from the main CPU 321 to an external management computer and instructions and data are received from the management computer.

Figure 4:
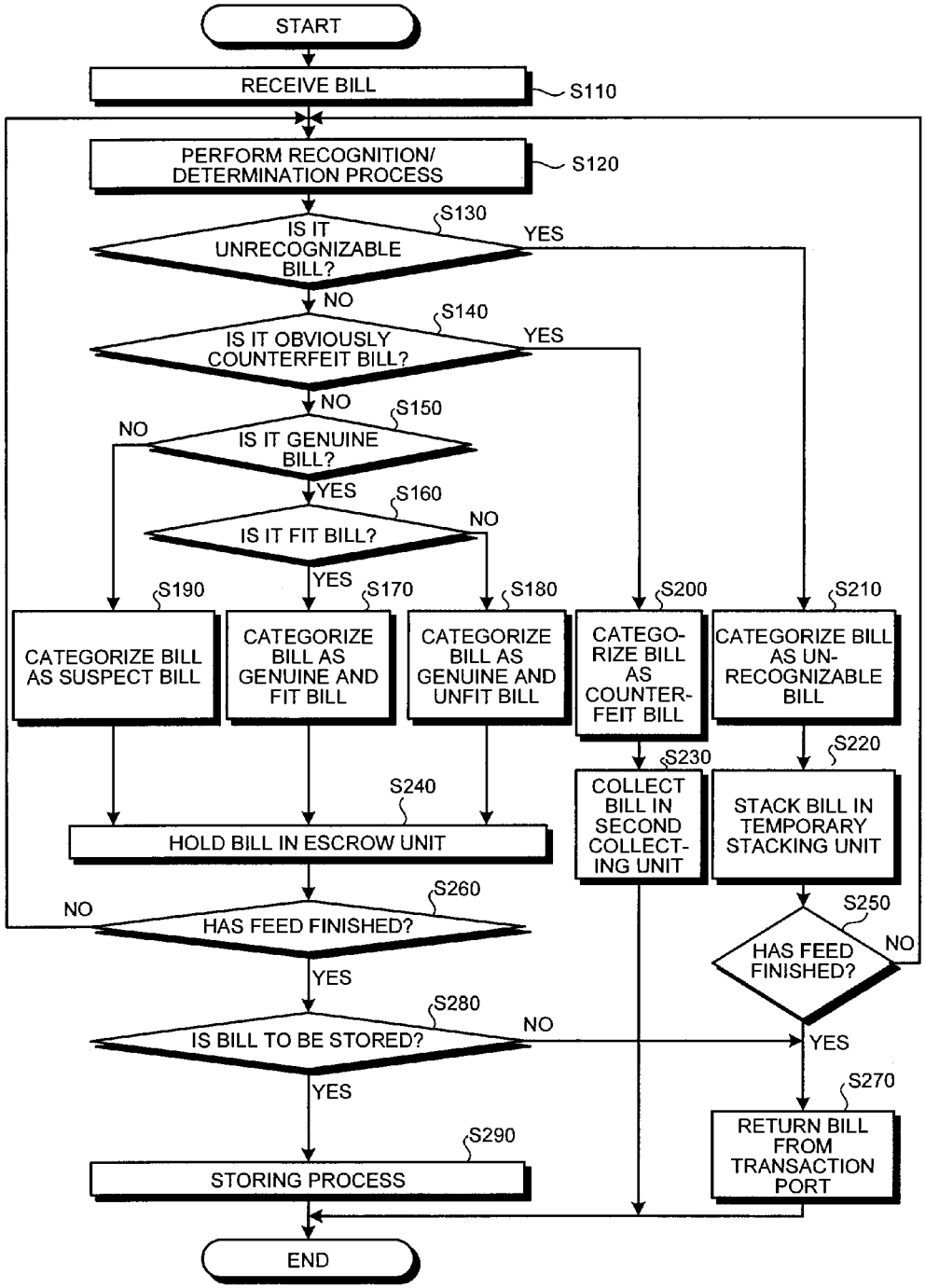
FIG. 4 is a flowchart for explaining an operation of the bill depositing and dispensing machine according to the first embodiment of the present invention.
Figure 5A:
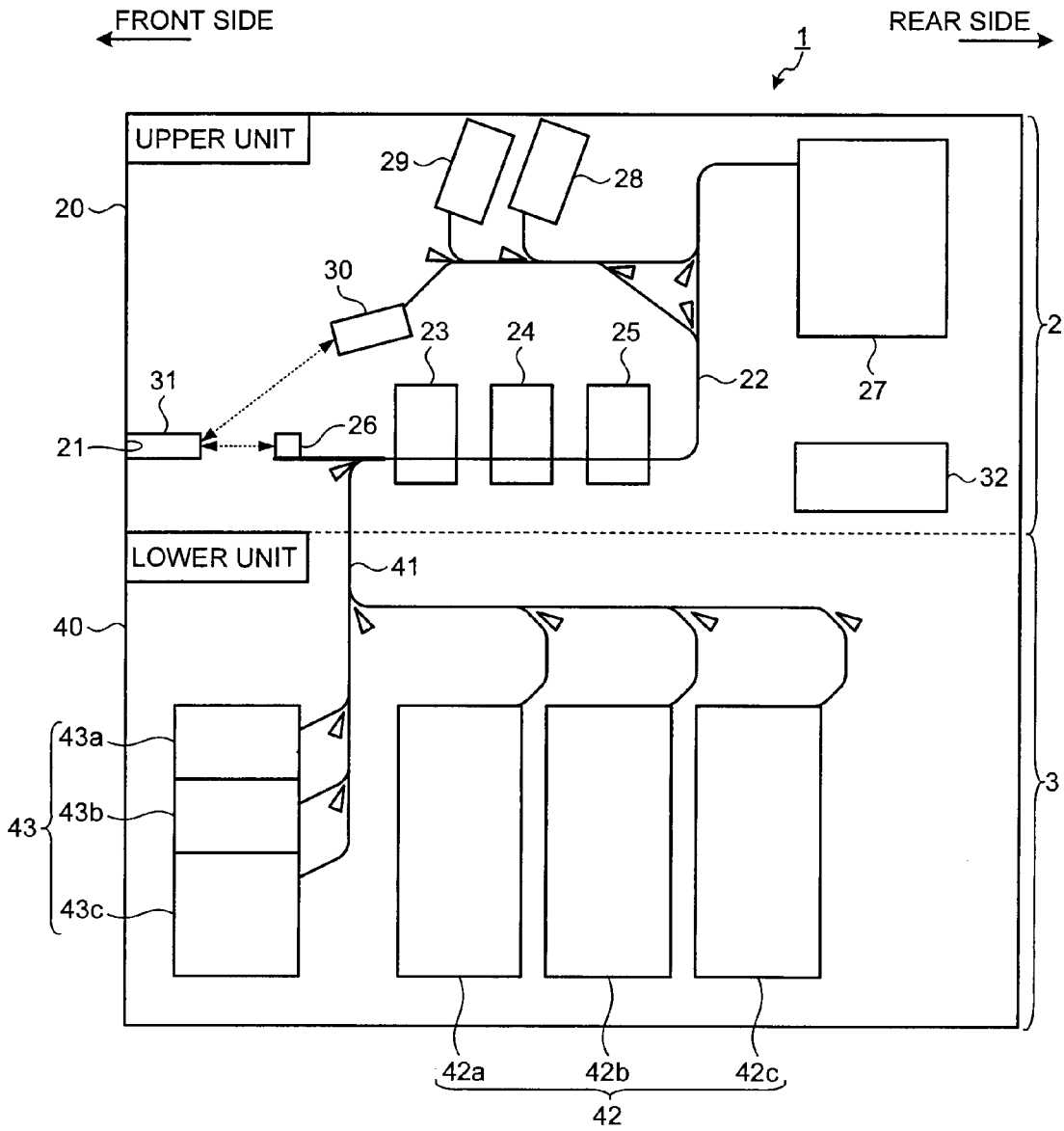
FIG. 5A is an explanatory diagram of an operation of the bill depositing and dispensing machine according to the first embodiment of the present invention.
Figure 5B:
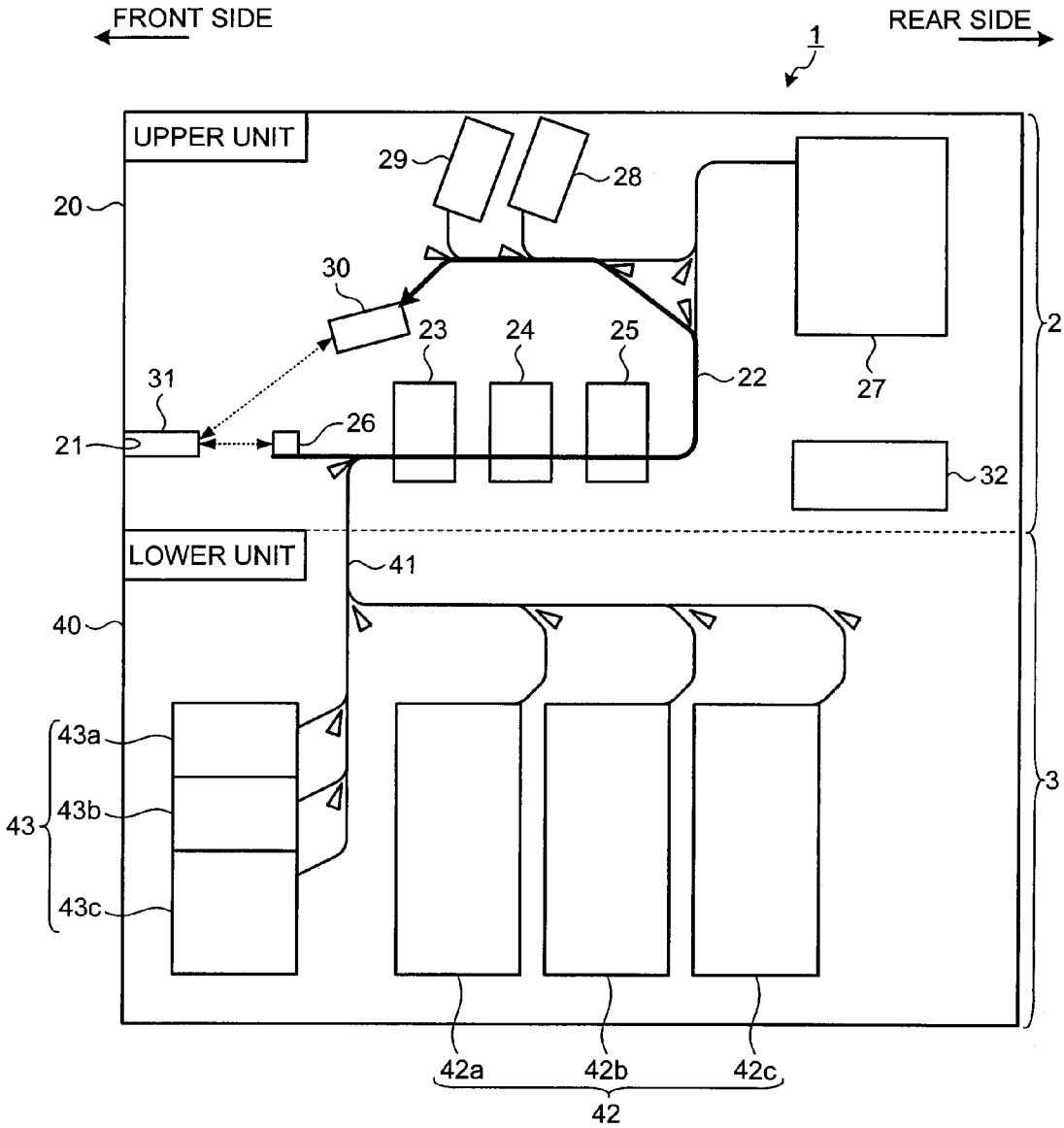
FIG. 5B is an explanatory diagram of an operation of the bill depositing and dispensing machine according to the first embodiment of the present invention.
Figure 5C:
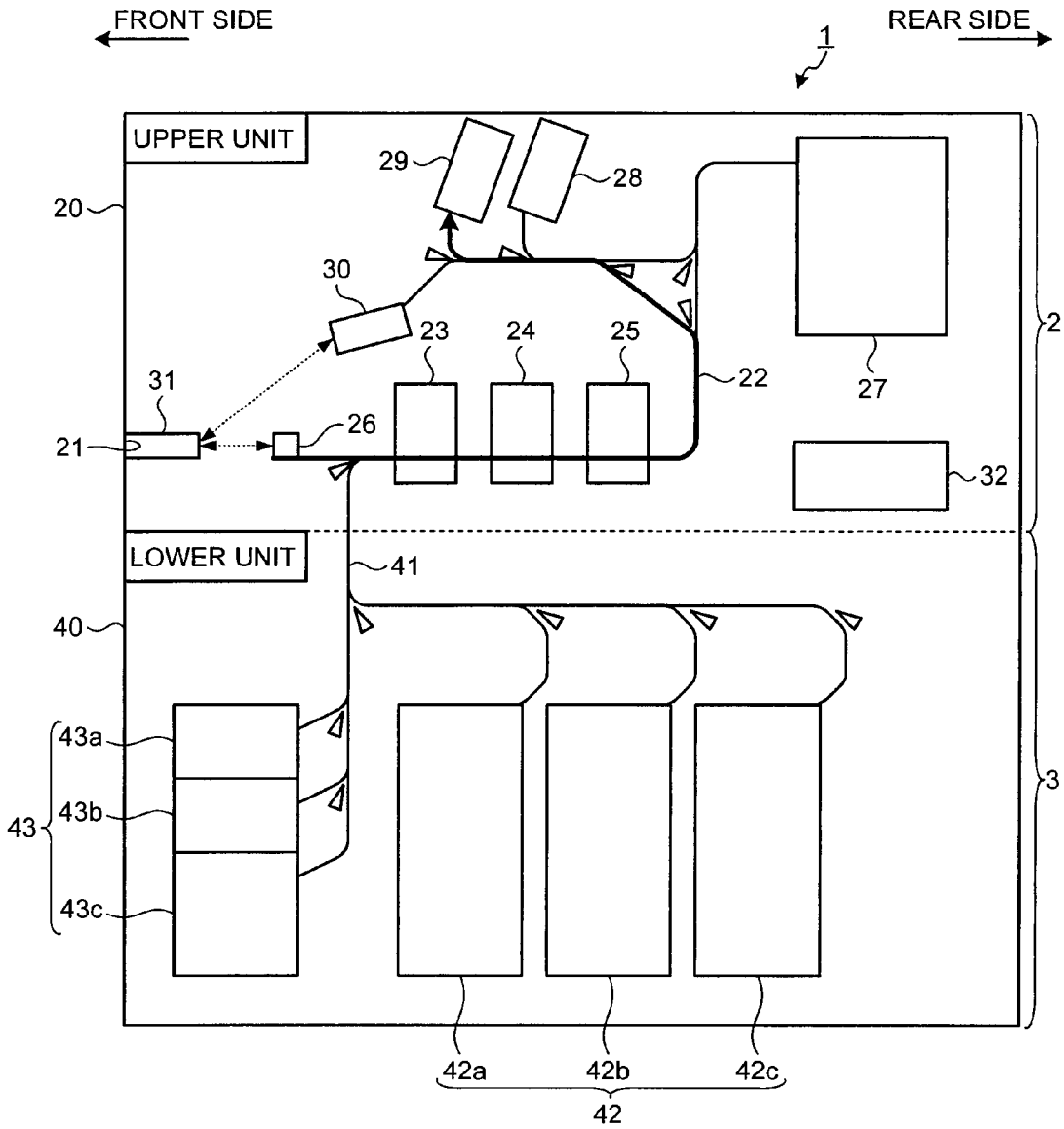
FIG. 5C is an explanatory diagram of an operation of the bill depositing and dispensing machine according to the first embodiment of the present invention.
Figure 5D:
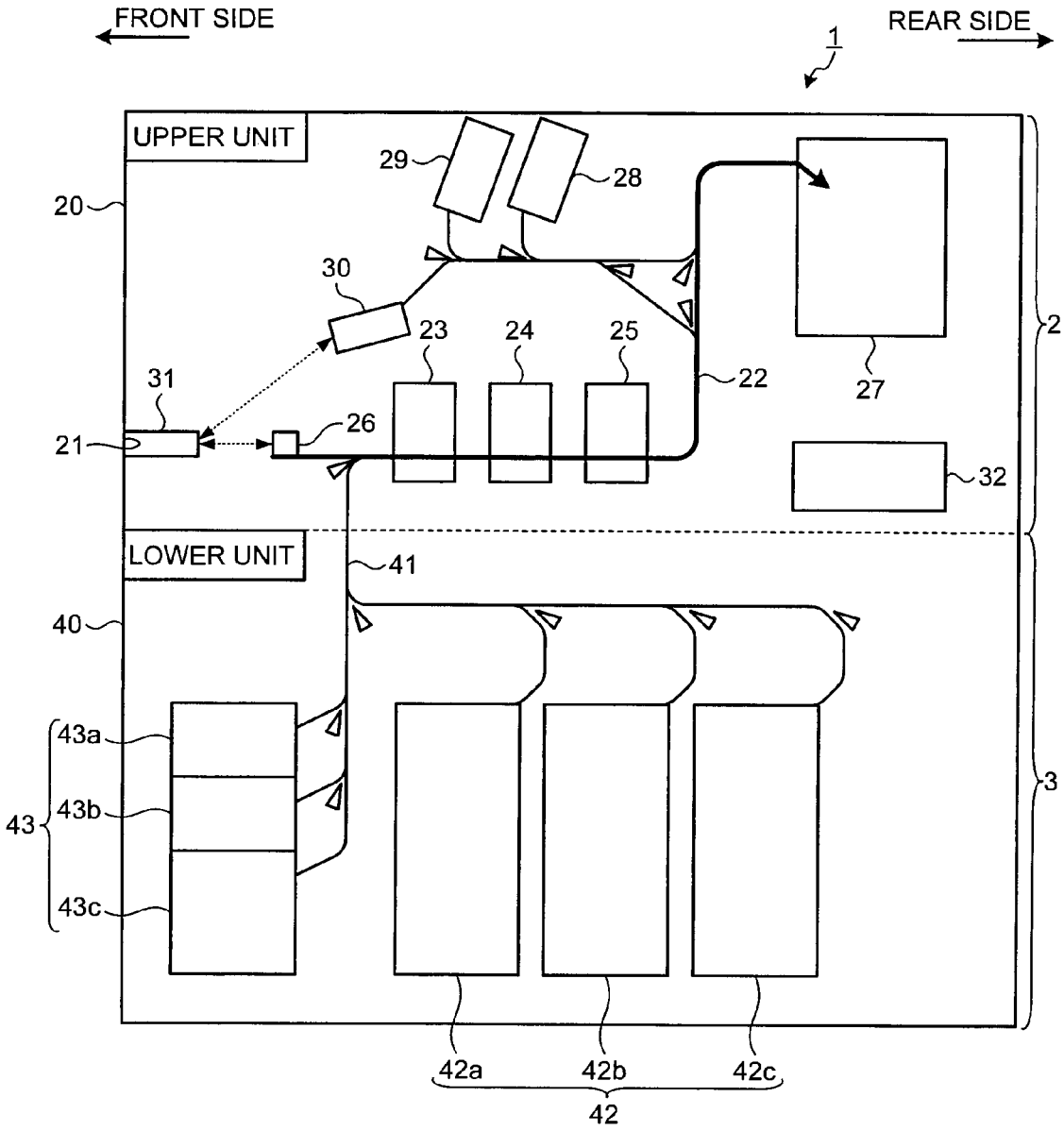
FIG. 5D is an explanatory diagram of an operation of the bill depositing and dispensing machine according to the first embodiment of the present invention.

An operation of the bill depositing and dispensing machine 1 is explained with reference to FIGS. 4 to 6. FIG. 4 is a flowchart for explaining an operation of the bill depositing and dispensing machine 1. FIGS. 5A to 5N are explanatory diagrams of the operation of the bill depositing and dispensing machine. It is assumed that a predetermined country is specified and set beforehand as the country to be referred to in the category classification table.

A flow of the bill at the time of making a deposit in the bill depositing and dispensing machine 1 is explained. At the time of making a deposit, a user loads the bills in the transaction port 21, and the bill depositing and dispensing machine 1 receives the bills via the transaction port 21 (Step S110). The received bills are carried into the transport path 22 by the receiving/ejecting mechanism 31 and the feeding unit 26 as shown in FIG. 5A. The bills carried into the transport path 22 are counted when the bill passes through the recognition/determination unit 25, and a recognition/determination process is performed (Step S120).

The recognition/determination unit 25 recognizes the denomination, authenticity, and fitness, thereby classifying the bills into five categories of genuine and fit bills (category 1), genuine and unfit bills (category 2), suspect bills that cannot be clearly determined as the genuine bills (category 3), counterfeit bills which are clearly different from the genuine bills and suspected as the counterfeit bills (category 4), and unrecognizable bills which are not a bills or cannot be recognized as bills (rejected bills, category 5).

That is, the bill fed by the feeding unit 26 is delivered to the transport path 22, and passes through the sensor unit 23 and the recognition/determination unit 25. At this time, the predetermined recognition security information of the bill (the feature amount in a specific part of the bill) is detected and obtained by the line sensor, magnetic sensor, thickness sensor, infrared sensor, or UV sensor.

The recognition/determination unit 25 then recognizes whether the bill is genuine or counterfeit and whether the bill is fit or unfit based on the respective pieces of recognition security information (the feature amount) obtained by the sensor unit 23 and performs category classification. First, the recognition/determination unit 25 recognizes whether the bill is genuine or counterfeit and whether the bill is fit or unfit, based on the respective pieces of recognition security information (the feature amount) and generates the recognition result information with regard to the respective pieces of recognition security information (the feature amount).

The recognition/determination unit 25 then refers to the recognition result information and the criteria for the respective pieces of recognition result information specific to the category classification of the predetermined country specified beforehand in the category classification table, to determine whether the bill is an unrecognizable bill (Step S130).

When it is determined that the bill is the "unrecognizable bill" (YES at Step S130), the recognition/determination unit 25 categorizes the bill as "unrecognizable bill" (Step S210). The bill categorized as "unrecognizable bill" is stacked in the temporary stacking unit 30 through the transport path 22 as shown in FIG. 5B (Step S220).

On the other hand, when it is not determined that the bill is the "unrecognizable bill" (NO at Step S130), the recognition/determination unit 25 determines whether the bill is an "obviously counterfeit bill" by referring to the recognition result information and the criteria for the respective pieces of recognition result information specific to the category classification of the predetermined country specified beforehand in the category classification table (Step S140).

When it is determined that the bill is the "counterfeit bill" (YES at Step S140), the recognition/determination unit 25 categorizes the bill as "counterfeit bill" (Step S200). The bill categorized as "counterfeit bill" is collected in the second collecting unit 29 through the transport path 22 as shown in FIG. 5C (Step S230). For the bills held in the second collecting unit 29, recognition information at the time of recognizing the bill is stored. At the time of collecting the bill, the serial number reader 24 reads the serial number of the bill to be collected and adds the serial number to the recognition information, and stores the recognition information as bill information.

On the other hand, when it is not determined that the bill is the "counterfeit bill" (NO at Step S140), the recognition/determination unit 25 determines whether the bill is a "genuine bill" by referring to the recognition result information and the criteria for the respective pieces of recognition result information specific to the category classification of the predetermined country specified beforehand in the category classification table (Step S150).

When it is not determined that the bill is the "genuine bill" (NO at Step S150), the recognition/determination unit 25 categorizes the bill as "suspect bill" (Step S190). The bill categorized as the "suspect bill" is held in the escrow unit 27 through the transport path 22 as shown in FIG. 5D (Step S240).

On the other hand, when it is determined that the bill is the "genuine bill" (YES at Step S150), the recognition/determination unit 25 determines whether the bill is a "fit bill" by referring to the recognition result information and the criteria for the respective pieces of recognition result information specific to the category classification of the predetermined country specified beforehand in the category classification table (Step S160).

When it is determined that the bill is the "fit bill" (YES at Step S160), the recognition/determination unit 25 categorizes the bill as "genuine and fit bill" (Step S170). The bill categorized as the "genuine and fit bill" is held in the escrow unit 27 through the transport path 22 as shown in FIG. 5D (Step S240).

When it is not determined that the bill is the "fit bill" (NO at Step S160), the recognition/determination unit 25 categorizes the bill as "genuine and unfit bill" (Step S180). The bill categorized as the "genuine and unfit bill" is held in the escrow unit 27 through the transport path 22 as shown in FIG. 5D (Step S240).

After Steps S220 and S240, the controller 32 determines whether feeding of the bills in the feeding unit 26 has finished (Steps S250 and S260), and when the carry-in of the bills by the feeding unit 26 has not yet finished (NO at Step S250, NO at Step S260), control returns to Step S120 to repeat these processes until the feeding of the bills by the feeding unit 26 has finished.

On the other hand, at a point in time when the feeding by the feeding unit 26 has finished (YES at Step S250, YES at Step S260), the unrecognizable bills stacked in the temporary stacking unit 30 are returned to the user from the transaction port 21 via the receiving/ejecting mechanism 31 (Step S270).

Subsequently, the bill depositing and dispensing machine 1 processes the bills temporarily held in the escrow unit 27. There are two processing modes, storing the bills or returning the bills. The controller 32 determines whether the bills temporarily held in the escrow unit 27 are to be stored or returned (Step S280). Upon reception of storage instruction information indicating that a deposit amount of the bills held in the escrow unit 27 is approved by the user, the controller 32 determines that the bills temporarily held in the escrow unit 27 are stored (YES at Step S280). The bills held in the escrow unit 27 are fed to the transport path 22 one by one, and the storing process is performed (Step S290).

The bills fed to the transport path 22 are transported in a direction opposite to the previous direction to pass through the recognition/determination unit 25, and the denomination, authenticity, and fitness are recognized again, and the category is determined. The bills whose denomination have been recognized by the recognition/determination unit 25 are transported to the lower unit 3 and stored in the bill storage 42 or the bill vault 43*a* or 43*b* through the transport path 41, and a series of processing finishes.

Figure 5E:
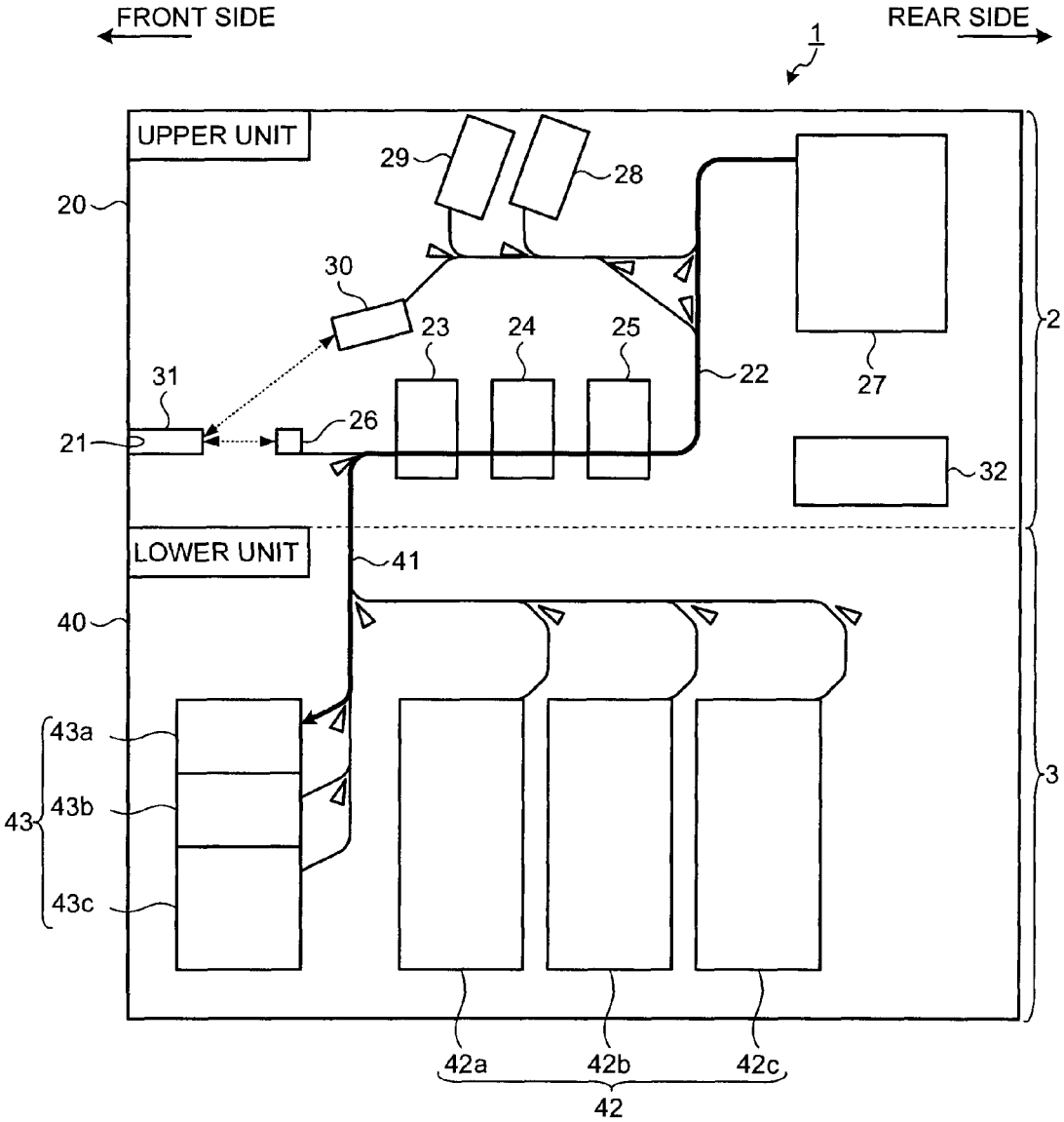
FIG. 5E is an explanatory diagram of an operation of the bill depositing and dispensing machine according to the first embodiment of the present invention.

That is, the bills held in the escrow unit 27 pass through the recognition/determination unit 25 through the transport path 22 as shown in FIG. 5E, the denomination, authenticity, and fitness are recognized again, and the category is determined. The bill categorized as the "suspect bill" in the recognition by the recognition/determination unit 25 is transported to the lower unit 3 as shown in FIG. 5E, stored in the bill vault 43*a* through the transport path 41, and the series of processing finishes. At the time of storage, the serial number reader 24 reads the serial number of the bill categorized as the "suspect bill" and stored in the bill vault 43*a* to add the serial number to the recognition information, and stores the recognition information as the bill information.

Figure 5F:
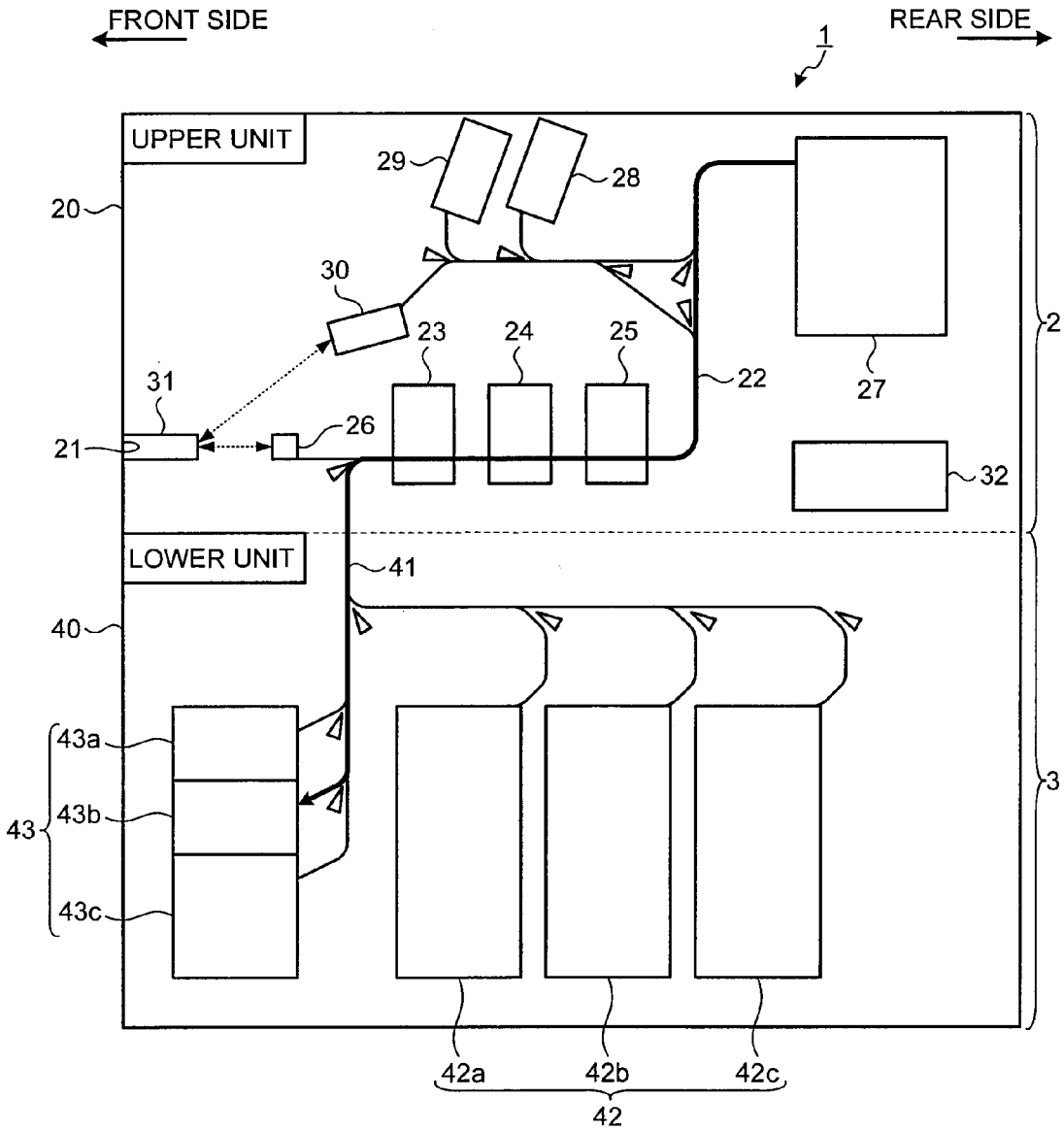
FIG. 5F is an explanatory diagram of an operation of the bill depositing and dispensing machine according to the first embodiment of the present invention.

The bill categorized as the "genuine and unfit bill" in the recognition by the recognition/determination unit 25 is transported to the lower unit 3 as shown in FIG. 5F and stored in the bill vault 43*b* through the transport path 41, and the series of processing finishes.

Figure 5G:
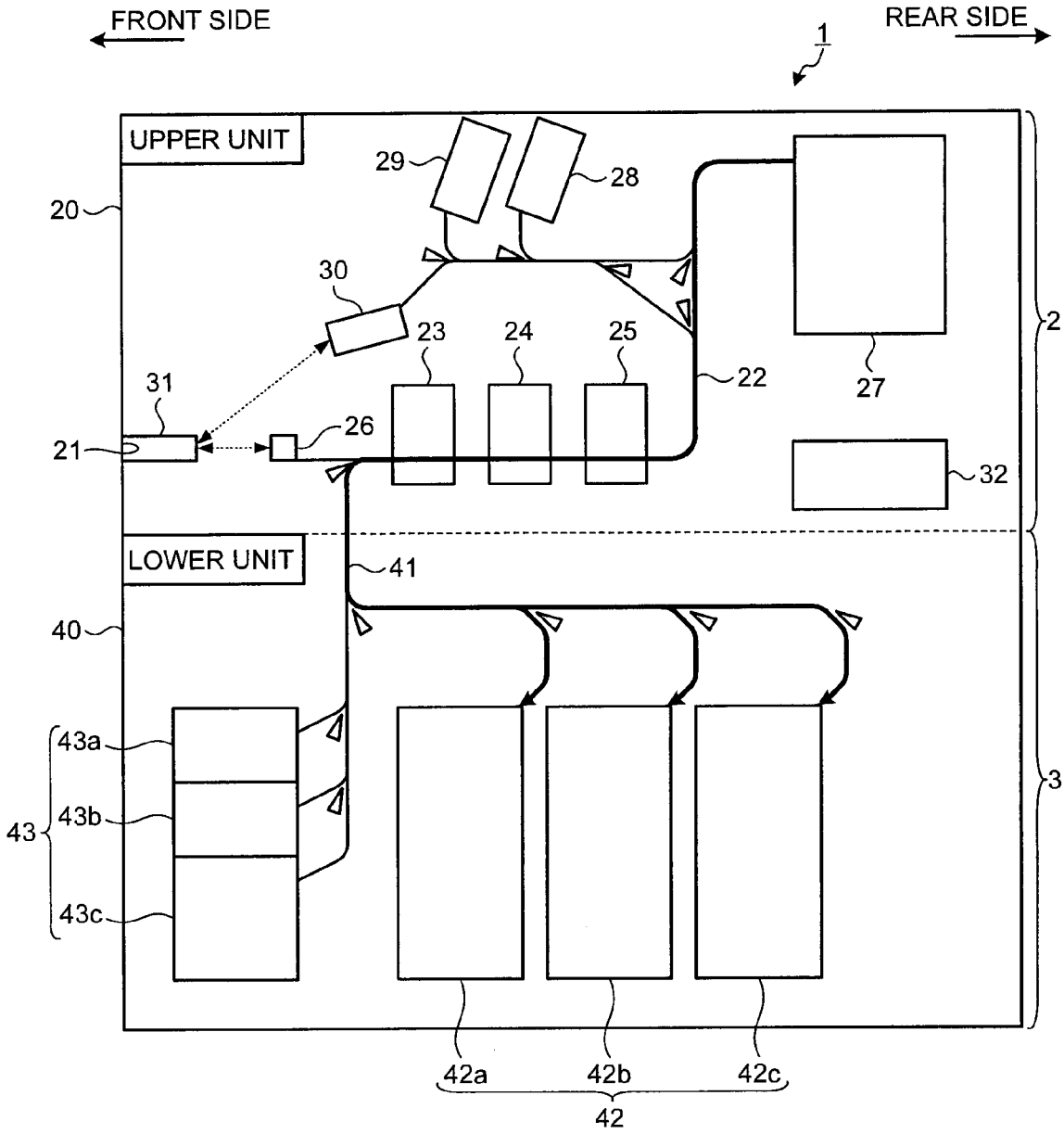
FIG. 5G is an explanatory diagram of an operation of the bill depositing and dispensing machine according to the first embodiment of the present invention.

The bill categorized as the "genuine and fit bill" in the recognition by the recognition/determination unit 25 is transported to the lower unit 3 as shown in FIG. 5G and stored in the bill storage 42*a*, 42*b*, or 42*c* according to the denomination through the transport path 41, and the series of processing finishes.

Figure 5H:
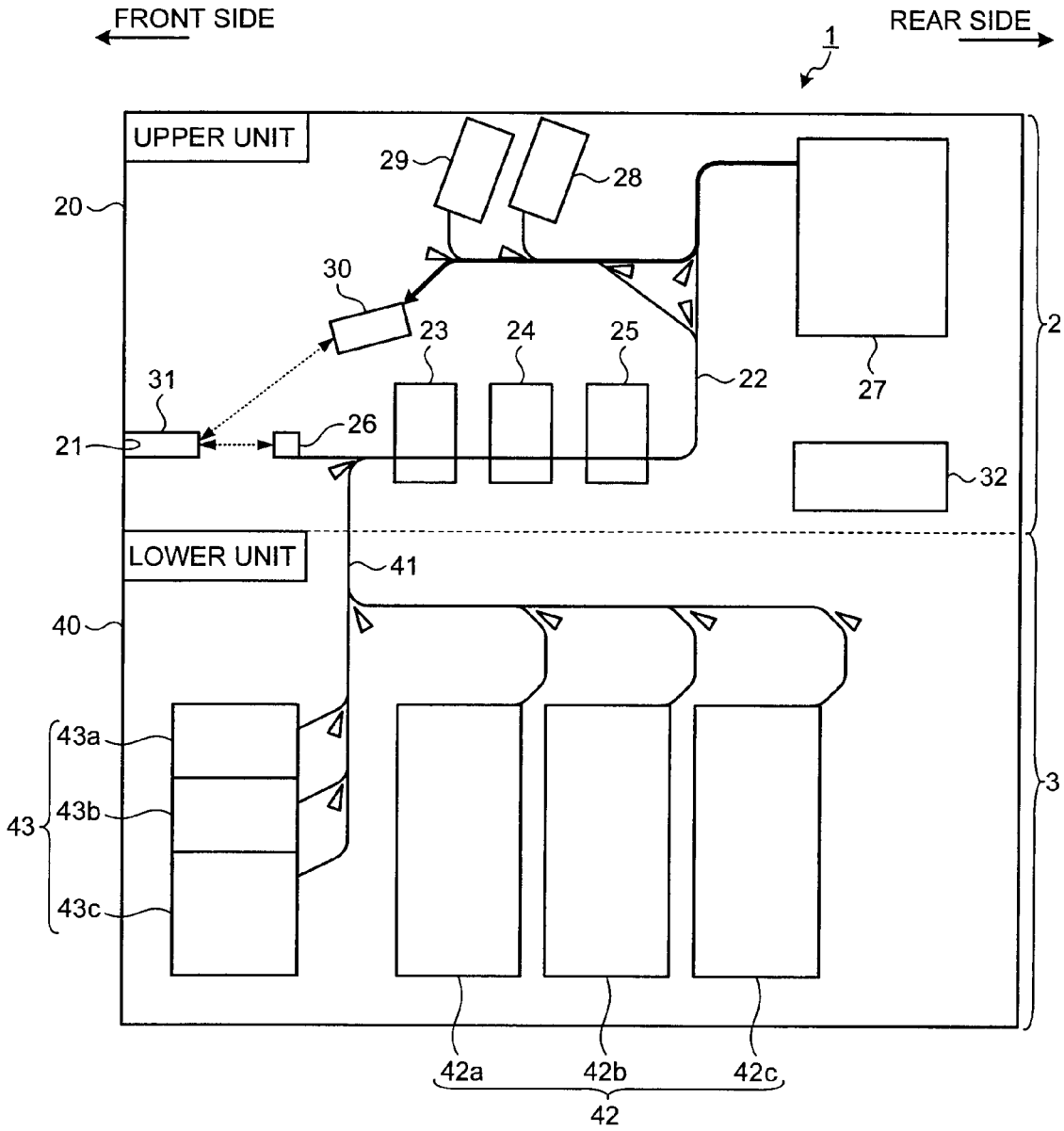
FIG. 5H is an explanatory diagram of an operation of the bill depositing and dispensing machine according to the first embodiment of the present invention.

On the other hand, when the deposit amount of the bills held in the escrow unit 27 is not approved by the user and a return request of the received bills is received, the controller 32 determines that the bills held in the escrow unit 27 are to be returned without storing the bills (NO at Step S280). The bills held in the escrow unit 27 are fed to the transport path 22 one by one, and a returning process is performed. That is, the bills held in the escrow unit 27 are stacked in the temporary stacking unit 30 through the transport path 22 as shown in FIG. 5H. The bills stacked in the temporary stacking unit 30 are returned to the user from the transaction port 21 via the receiving/ejecting mechanism 31, and the series of processing finishes (Step S270).

Figure 5I:
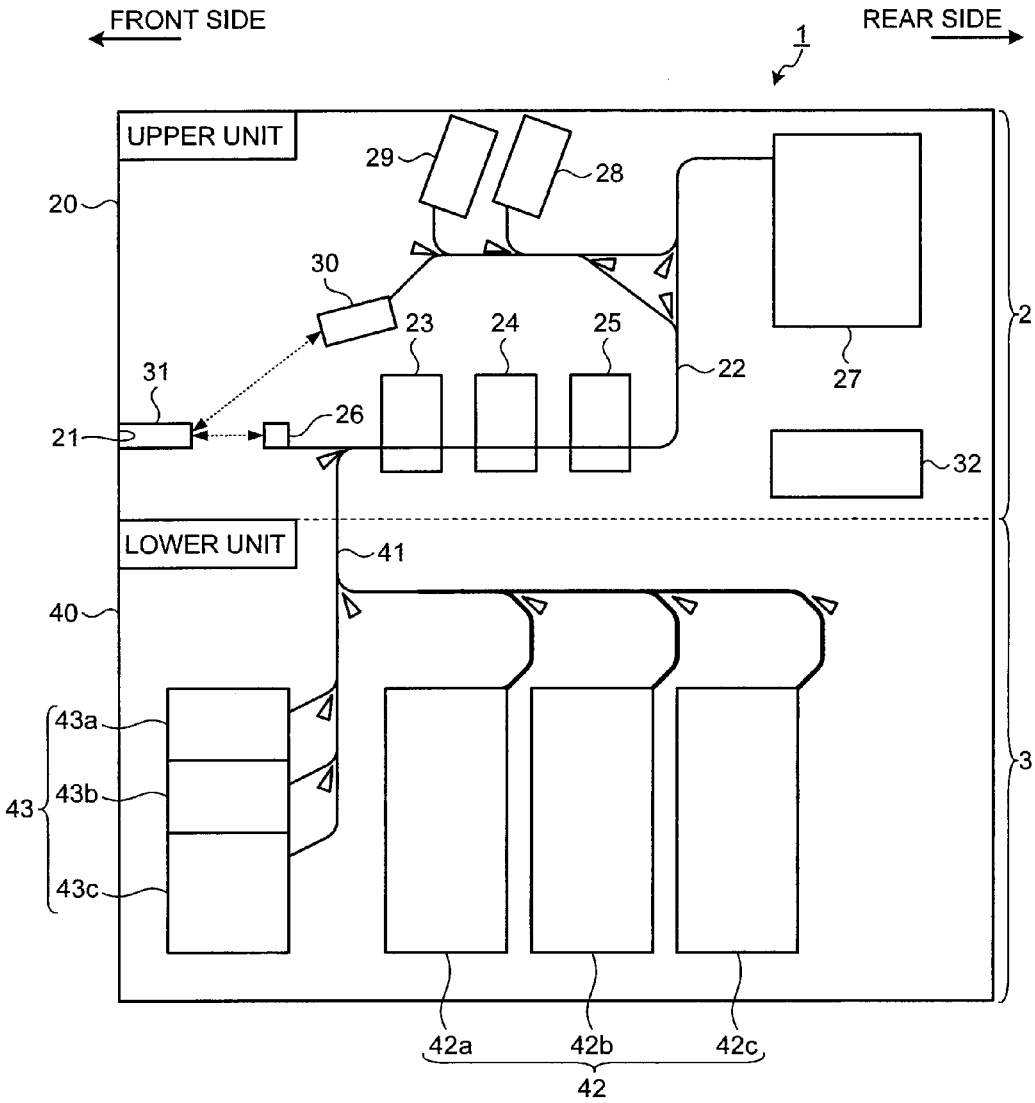
FIG. 5I is an explanatory diagram of an operation of the bill depositing and dispensing machine according to the first embodiment of the present invention.

A flow of the bill at the time of withdrawal in the bill depositing and dispensing machine 1 is explained with reference to FIGS. 5I to 5N. When the user requests a withdrawal of a desired amount of money, as shown in FIG. 5I, the bills stored in the bill storages 42*a*, 42*b*, and 42*c* of the lower unit 3 are fed to the transport path 41 one by one according to the requested amount. The bills fed to the transport path 41 are transported to the upper unit 2 side, and pass through the recognition/determination unit 25 through the transport path 22, and the denomination thereof is recognized.

Figure 5J:
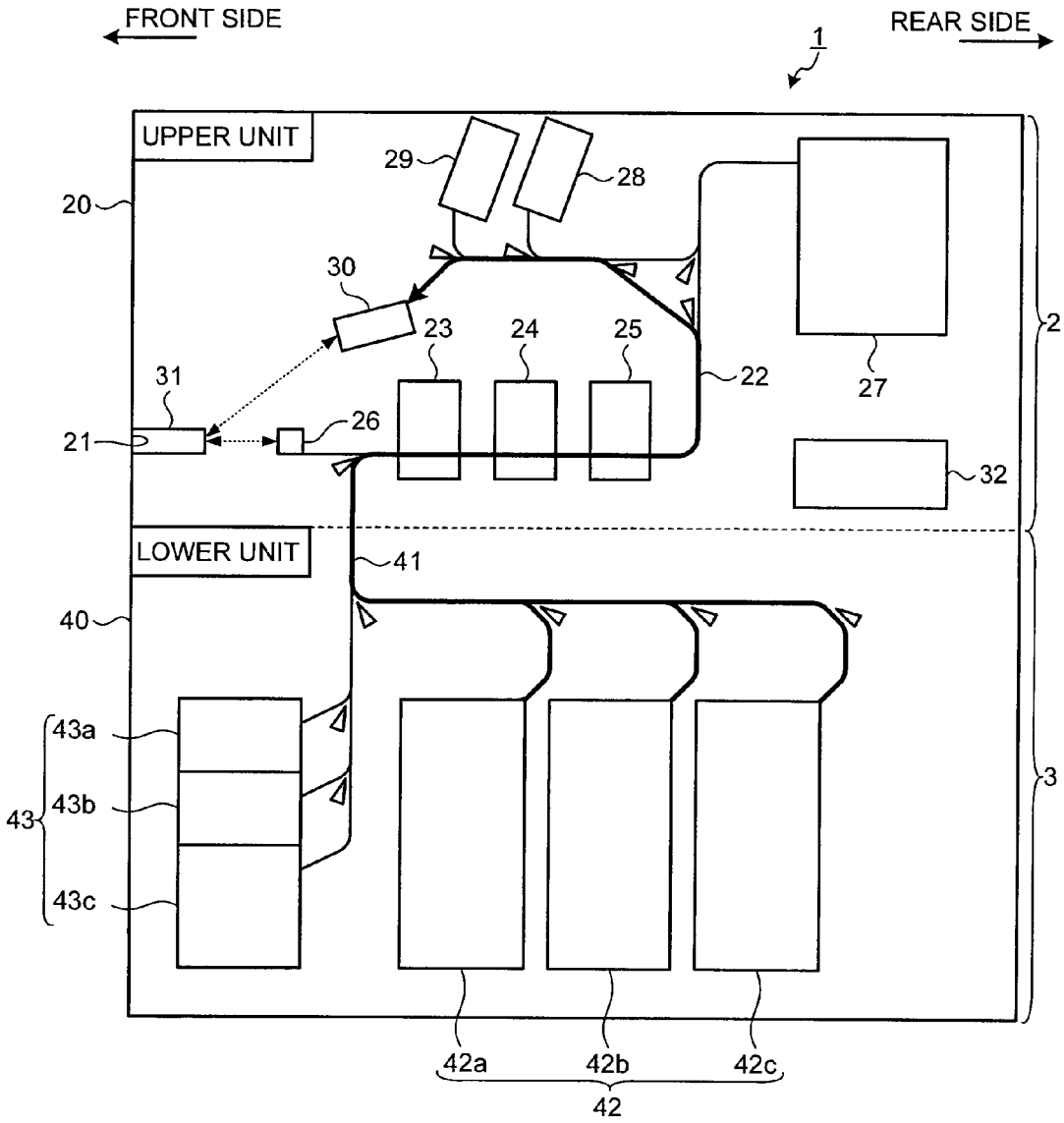
FIG. 5J is an explanatory diagram of an operation of the bill depositing and dispensing machine according to the first embodiment of the present invention.
Figure 5K:
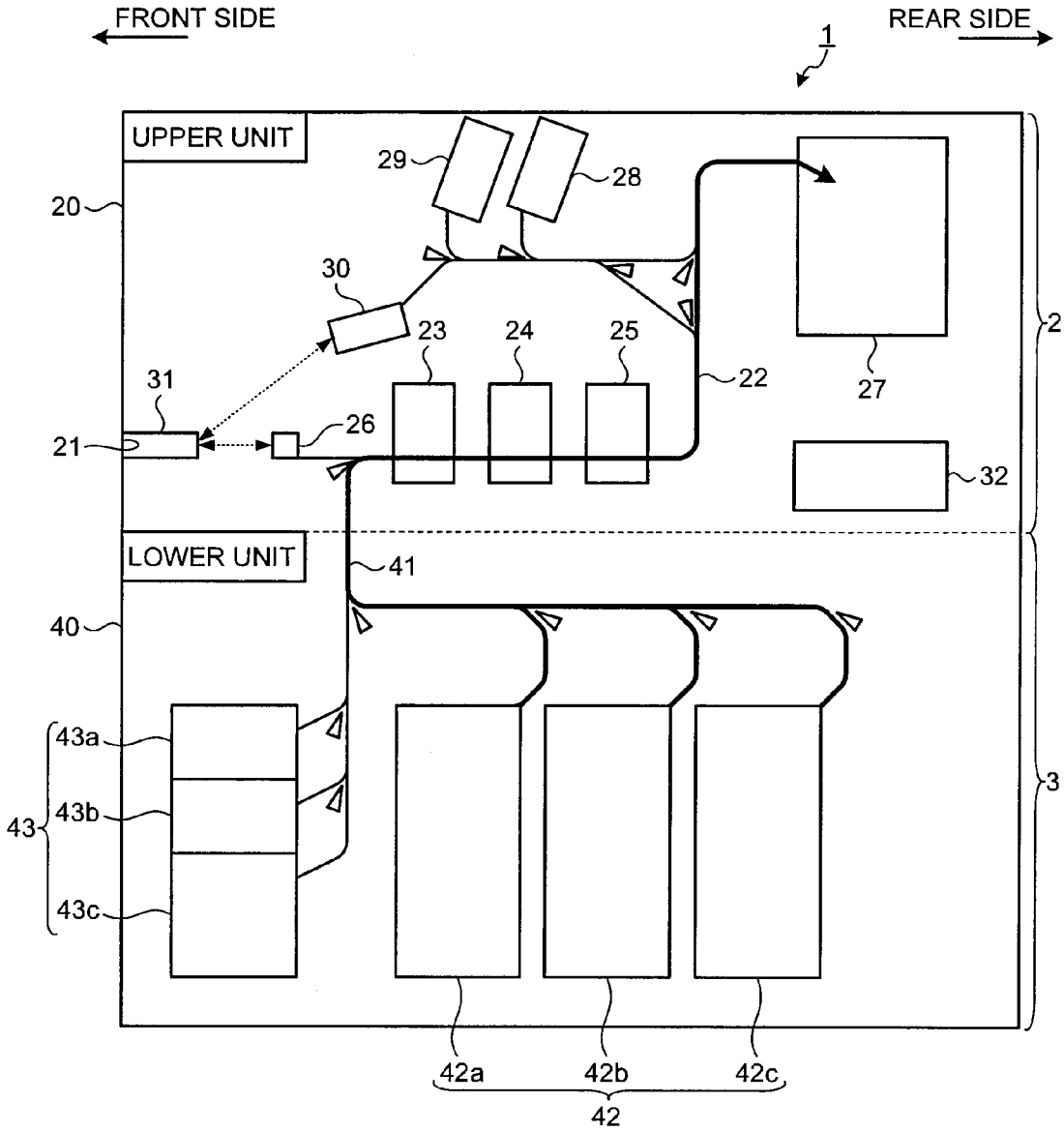
FIG. 5K is an explanatory diagram of an operation of the bill depositing and dispensing machine according to the first embodiment of the present invention.

The bills whose denomination have been recognized by the recognition/determination unit 25 are stacked, as shown in FIG. 5J, in the temporary stacking unit 30 through the transport path 22. The bill, whose denomination cannot be recognized by the recognition/determination unit 25 due to skew or double feeding, is held in the escrow unit 27 through the transport path 22 as shown in FIG. 5K. The temporary stacking unit 30 stacks therein the bills until the bills reach the requested amount. The bills for the requested amount stacked in the temporary stacking unit 30 are given to the user from the transaction port 21 via the receiving/ejecting mechanism 31.

Figure 5L:
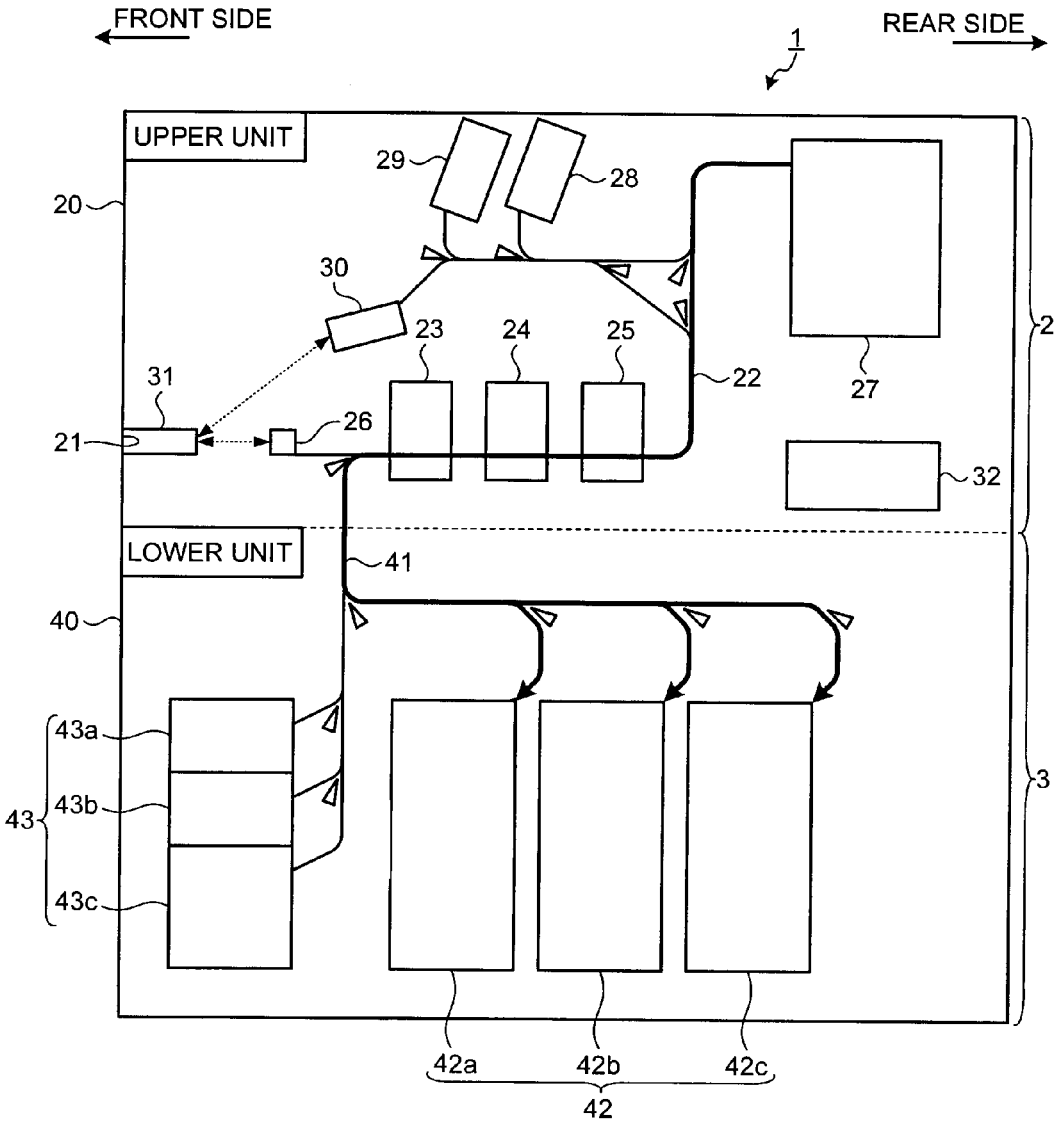
FIG. 5L is an explanatory diagram of an operation of the bill depositing and dispensing machine according to the first embodiment of the present invention.
Figure 5M:
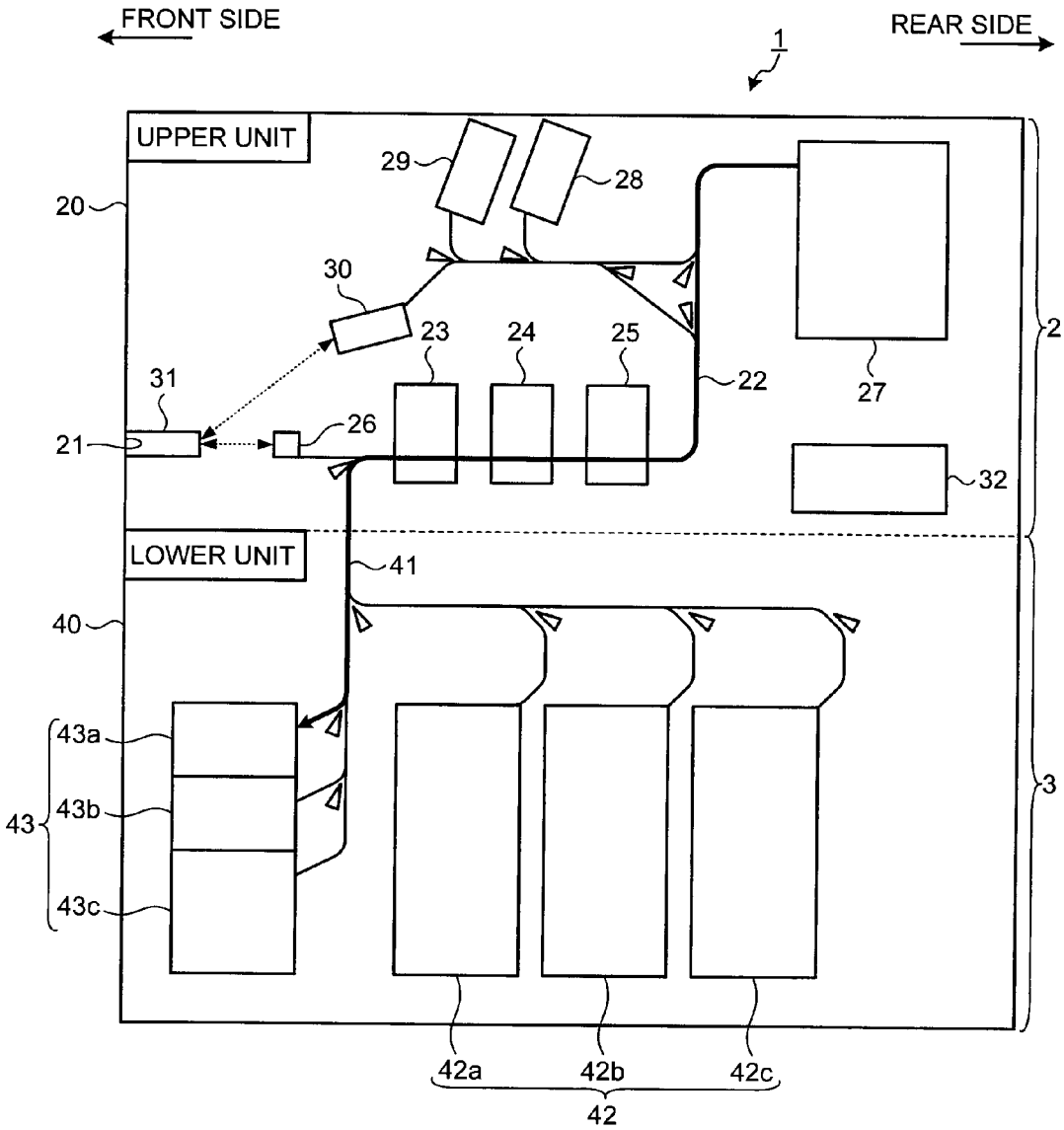
FIG. 5M is an explanatory diagram of an operation of the bill depositing and dispensing machine according to the first embodiment of the present invention.
Figure 5N:
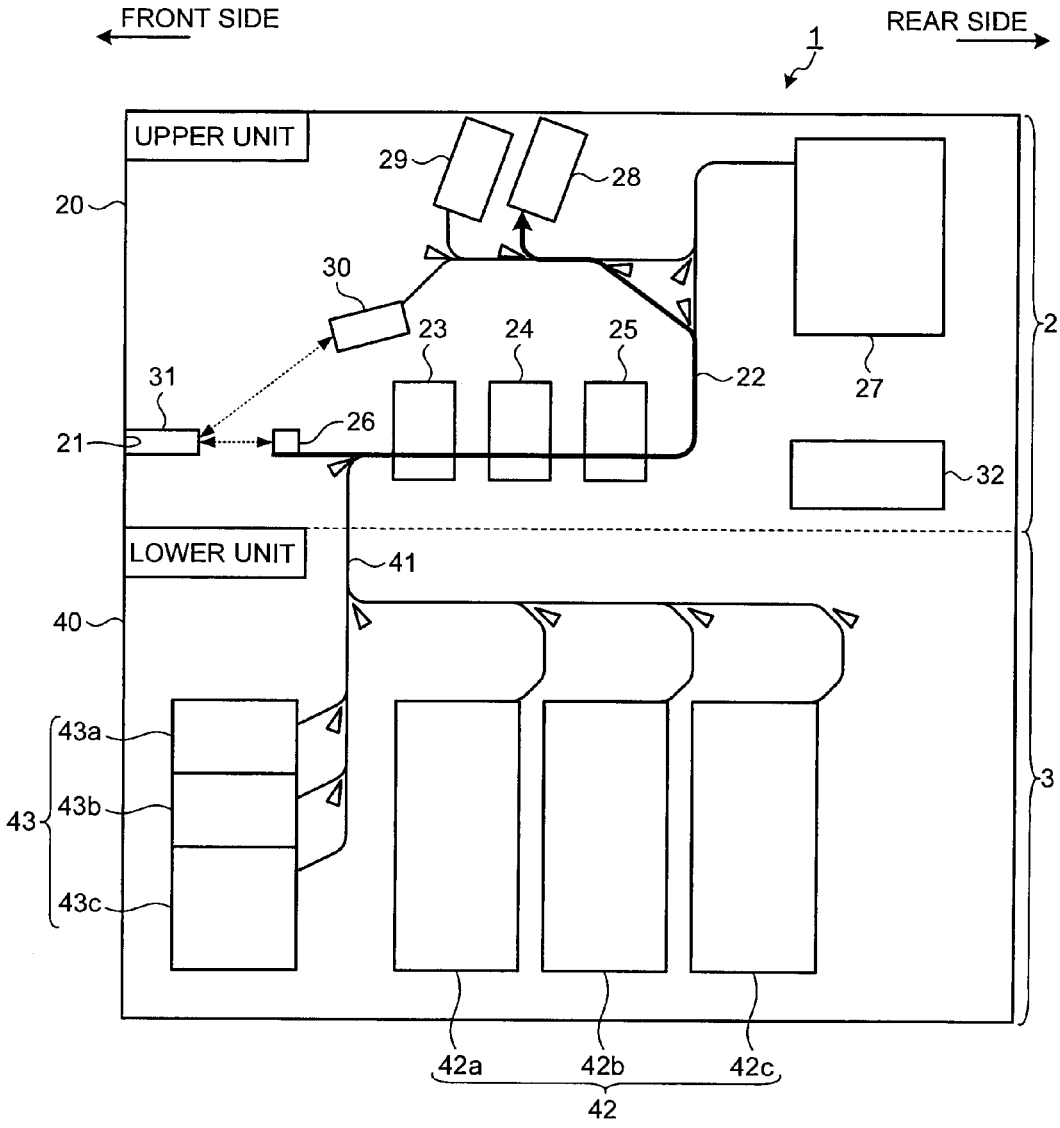
FIG. 5N is an explanatory diagram of an operation of the bill depositing and dispensing machine according to the first embodiment of the present invention.

When the ejection of the bills for the requested amount to the user has finished, the bills held in the escrow unit 27 are fed to the transport path 22 one by one, transported in a direction opposite to the previous direction to pass through the recognition/determination unit 25, and the denomination is recognized again. The bills whose denomination have been recognized by the recognition/determination unit 25 are transported to the lower unit 3 as shown in FIG. 5L and stored in the bill storages 42*a*, 42*b*, and 42*c* according to the denomination through the transport path 41. The bill whose denomination cannot be recognized by the recognition/determination unit 25 is transported to the lower unit 3 as shown in FIG. 5M, and stored in the bill vault 43*a* through the transport path 41.

When the user forgets to take the withdrawn bills from the transaction port 21 at the time of withdrawal, or when the user forgets to take the returned bill from the transaction port 21 at the time of depositing, the bill is carried into the transport path 22 via the receiving/ejecting mechanism 31 and the feeding unit 26 as shown in FIG. 5N, and the denomination, authenticity, and the like are recognized again by the recognition/determination unit 25 and the bills are collected in the first collecting unit 28.

For a transaction performed by the above processes, various pieces of information is transmitted to the management computer and coordinated as transaction information.

FIG. 6 is one example of the transaction information, where "1 transaction information" includes apparatus number, processing number (the number obtained by combining a type of processing such as deposit, return, and deposit return and a consecutive number of processing), processing starting date and processing finishing date including year, month, date, hour, minute, and second, customer information including an account number and fingerprint information, counting information including number of bills per denomination, amount, total number of bills, and total amount, and bill information for the number of processed bills. The bill information also includes the identification information.

The transaction information is created at the time of a storage and returning process, however, the transaction information can include only the unauthentic bill and the questionable bill with uncertain authenticity. The series of processing for deposit and withdraw is performed by the controller 32.

As described above, because the bill depositing and dispensing machine 1 according to the present embodiment includes the category classification table, the bill depositing and dispensing machine 1 can promptly change the criteria for the category determination and can easily support the category determination with individual criteria for each country only by specifying the country based on the country specification information. By preparing a plurality of criteria in the same country, the flexible category determination can be supported easily. In the bill depositing and dispensing machine 1 according to the present embodiment, because the user can add or change the information in the category classification table, the bill depositing and dispensing machine 1 can easily and promptly support the flexible category determination as required. Therefore, the bill depositing and dispensing machine 1 according to the present embodiment can recognize the bill promptly and flexibly adapting to the different use areas and bills to be used.

The category determination criteria of a new country can be easily added by adding or changing the information in the category classification table, without requiring individual development of a recognition apparatus exclusively for the new country. Therefore, even if the category determination criteria are changed or use thereof is desired in a country having new category determination criteria, adaptation is possible only by adding or changing the information in the category classification table, thereby enabling to recognize the bills at a low cost.

Second Embodiment

Figure 7A:
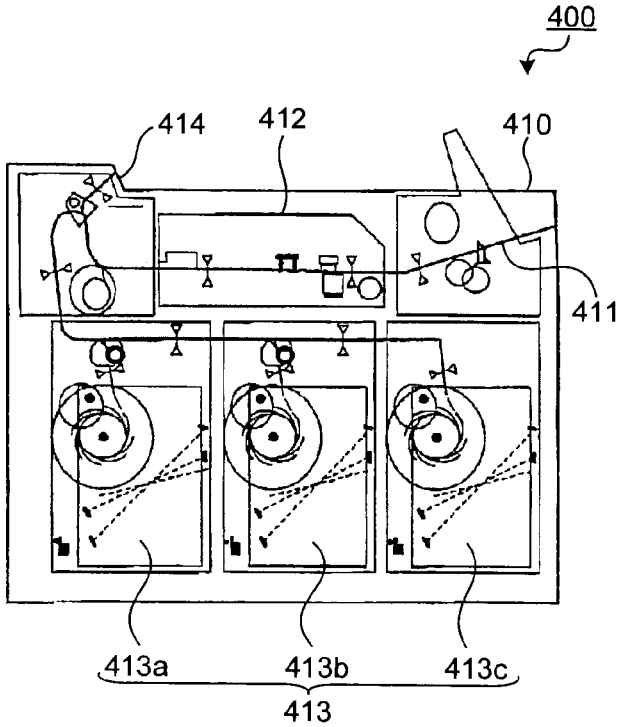
FIG. 7A is a sectional view of a bill recognization/sort machine according to a second embodiment of the present invention.
Figure 7B:
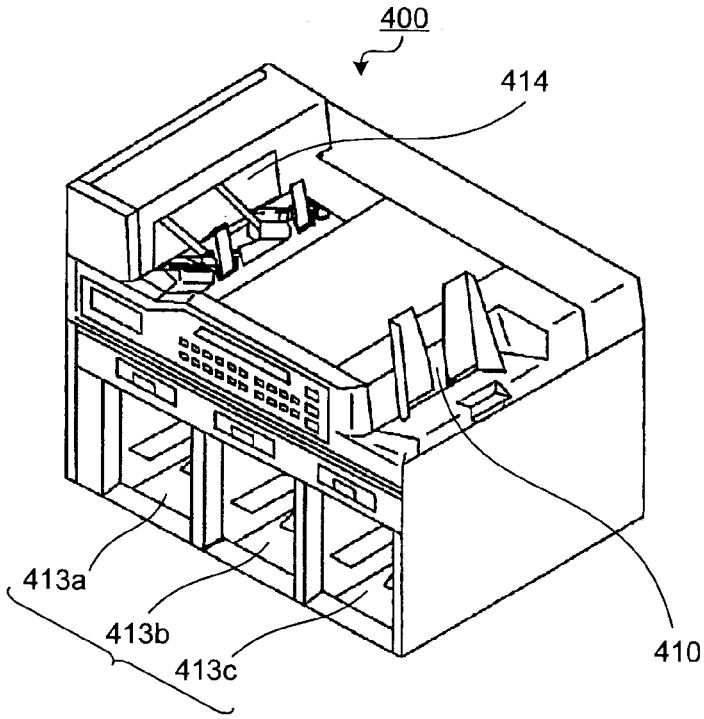
FIG. 7B is a perspective view of the bill recognization/sort machine according to the second embodiment of the present invention.

FIGS. 7A and 7B depict a bill recognition/sort machine 400 according to a second embodiment. FIG. 7A is a sectional view of a schematic configuration of the bill recognition/sort machine 400, and FIG. 7B is a perspective view of the bill recognition/sort machine 400. The bill recognition/sort machine 400 according to the present embodiment has a function as the paper-sheet recognition apparatus of the present invention, and is mainly installed and used at banking institutions such as banks and post offices.

The bill recognition/sort machine 400 according to the present embodiment includes, as shown in FIGS. 7A and 7B, a bill receiving unit 410, a transport path 411, a recognition unit 412, a stacking unit 413 (stacking units 413*a*, 413*b*, 413*c*, and 413*d*), and a returning unit 414. The bill receiving unit 410 receives the bills like the transaction port 21 in the bill depositing and dispensing machine 1 explained in the first embodiment.

The bill received by the bill receiving unit 410 is fed and transported to the transport path 411 and passes through the recognition unit 412. The recognition unit 412 has the same function as that of the recognition/determination unit 25 explained in the present embodiment. However, in the present embodiment, a sensor unit 415 is formed on a part of the transport path 411 in the recognition unit 412. The sensor unit 415 has the same function as that of the sensor unit 23 explained in the first embodiment.

That is, the sensor unit 415 detects a feature amount indicating a shape of the bill, a feature amount indicating a magnetic content included in the bill, and a feature amount indicating a quantity or wavelength of light transmitted through or reflected by the bill, as various security information (a feature amount in a specific part of the bill) such as the shape or image of the bill, and magnetism or a magnetic thread applied to the bill to prevent counterfeiting.

The recognition unit 412 recognizes whether the bill is genuine or counterfeit, and fit or unfit, based on a plurality of pieces of recognition security information of the bill detected by a plurality of sensors in the sensor unit 415 (the feature amount in a specific part of the bill) and a category classification table held in the recognition unit 412, to determine the category. The recognition unit 412 recognizes the denomination, authenticity, and fitness, and classifies the bills into five categories of genuine and fit bill (category 1), genuine and unfit bill (category 2), suspect bill that cannot be clearly determined as the genuine bill (category 3), counterfeit bill which is clearly different from the genuine bill and suspected as the counterfeit bill (category 4), and unrecognizable bill which is not a bill or cannot be recognized as the bill (rejected bill, category 5).

The bill having subjected to a recognition process of the denomination, authenticity, and fitness, and the category determination by the recognition unit 412 is transported to the stacking unit 413 through the transport path 411 and stored based on the category determination result. As a result of the recognition process by the recognition unit 412, the bill to be returned to the user without being stored in the stacking unit 413 is transported to the returning unit 414 through the transport path 411.

Third Embodiment

Figure 8A:
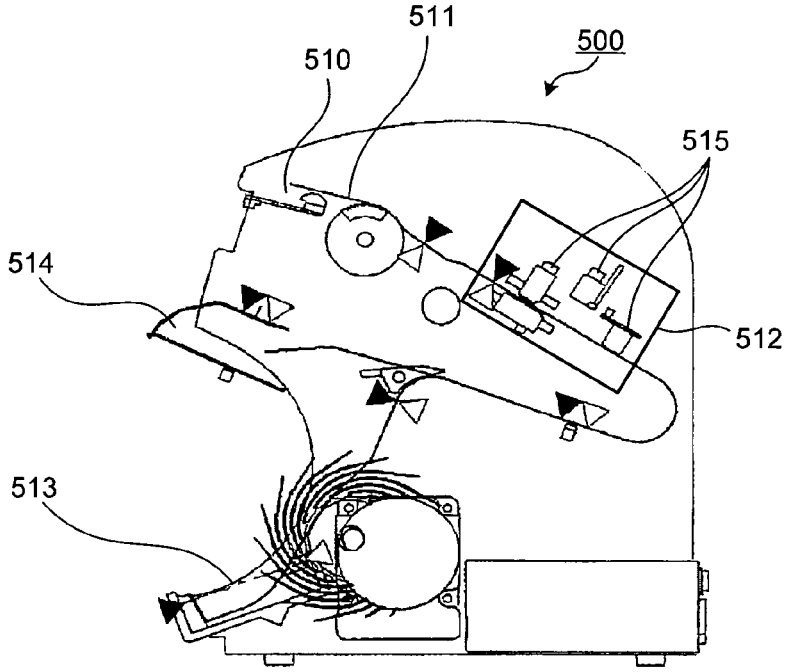
FIG. 8A is a sectional view of a bill recognization/count machine according to a third embodiment of the present invention.
Figure 8B:
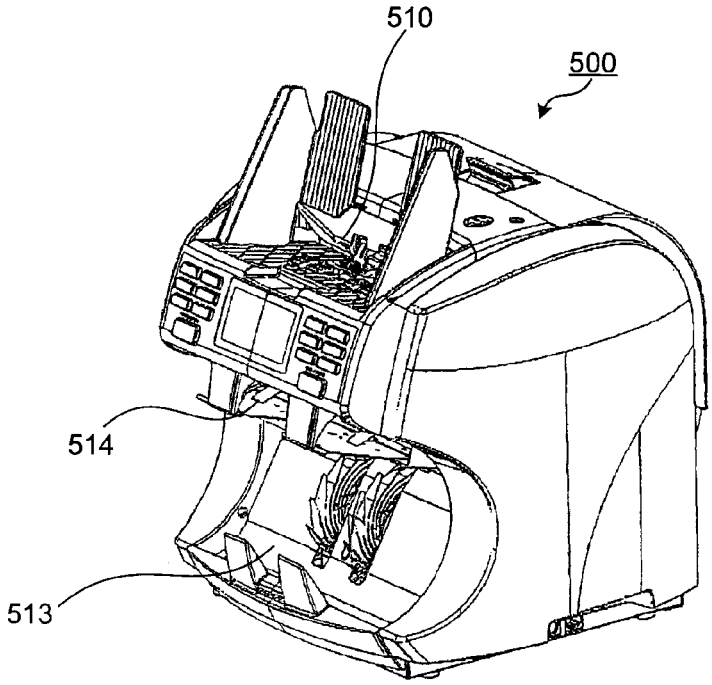
FIG. 8B is a perspective view of the bill recognization/count machine according to the third embodiment of the present invention.

FIGS. 8A and 8B depict a bill recognition/count machine 500 according to a third embodiment. FIG. 8A is a sectional view of a schematic configuration of the bill recognition/count machine 500, and FIG. 8B is a perspective view of the bill recognition/count machine 500. The bill recognition/count machine 500 according to the present embodiment has a function as the paper-sheet recognition apparatus of the present invention, and is mainly installed and used at banking institutions such as banks and post offices.

The bill recognition/count machine 500 according to the present embodiment includes, as shown in FIGS. 8A and 8B, a bill receiving unit 510, a transport path 511, an recognition unit 512, a stacking unit 513, and a returning unit 514. The bill receiving unit 510 receives the bills like the transaction port 21 in the bill depositing and dispensing machine 1 explained in the first embodiment.

The bill received by the bill receiving unit 510 is fed and transported to the transport path 511 and passes through the recognition unit 512. The recognition unit 512 has the same function as that of the recognition/determination unit 25 explained in the first embodiment. However, in the present embodiment, a sensor unit 515 is formed on a part of the transport path 511 in the recognition unit 512. The sensor unit 515 has the same function as that of the sensor unit 23 explained in the first embodiment.

That is, the sensor unit 515 detects a feature amount indicating a shape of the bill, a feature amount indicating a magnetic content included in the bill, and a feature amount indicating a quantity or wavelength of the light transmitted through or reflected by the bill, as various security information (a feature amount in a specific part of the bill) such as the shape or image of the bill, and magnetism or a magnetic thread applied to the bill to prevent counterfeiting.

The recognition unit 512 recognizes whether the bill is genuine or counterfeit, and fit or unfit, based on a plurality of pieces of recognition security information of the bill detected by a plurality of sensors in the sensor unit 515 (the feature amount in a specific part of the bill) and a category classification table held in the recognition unit 512, to determine the category. The recognition unit 512 recognizes the denomination, authenticity, and fitness, and classifies the bills into five categories of genuine and fit bill (category 1), genuine and unfit bill (category 2), suspect bill that cannot be clearly determined as the genuine bill (category 3), counterfeit bill which is clearly different from the genuine bill and suspected as the counterfeit bill (category 4), and unrecognizable bill which is not a bill or cannot be recognized as the bill (rejected bill, category 5).

The bill having subjected to a recognition process of the denomination, authenticity, and fitness, and the category determination by the recognition unit 512 is transported to the stacking unit 513 through the transport path 511 and stored based on the category determination result. As a result of the recognition process by the recognition unit 512, the bill to be returned to the user without being stored in the stacking unit 513 is transported to the returning unit 514 through the transport path 511.

Fourth Embodiment

Figure 9A:
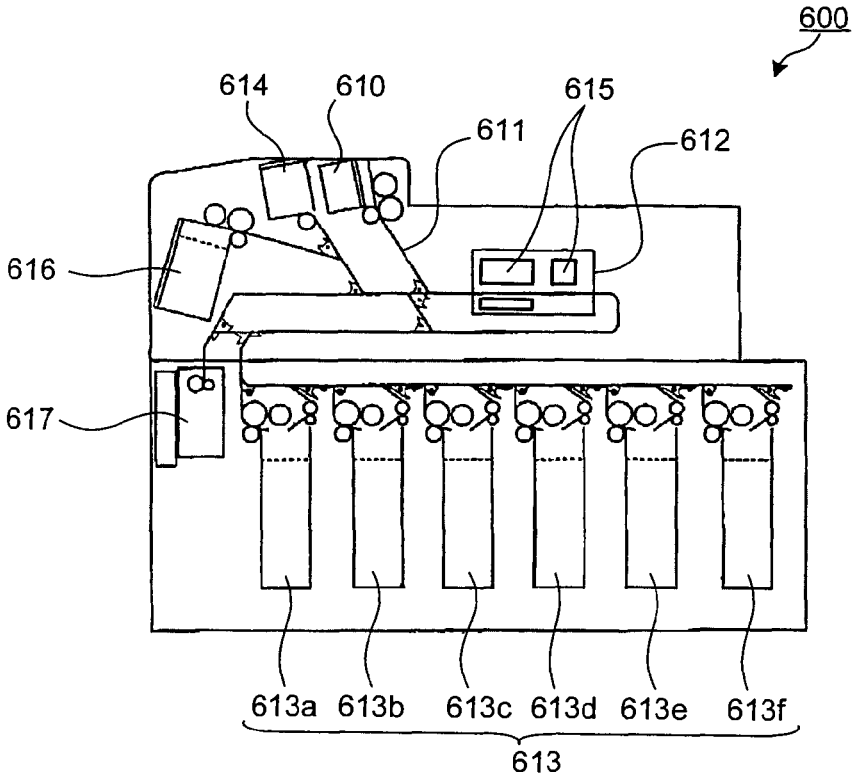
FIG. 9A is a sectional view of a circulation-type bill depositing and dispensing machine according to a fourth embodiment of the present invention.
Figure 9B:
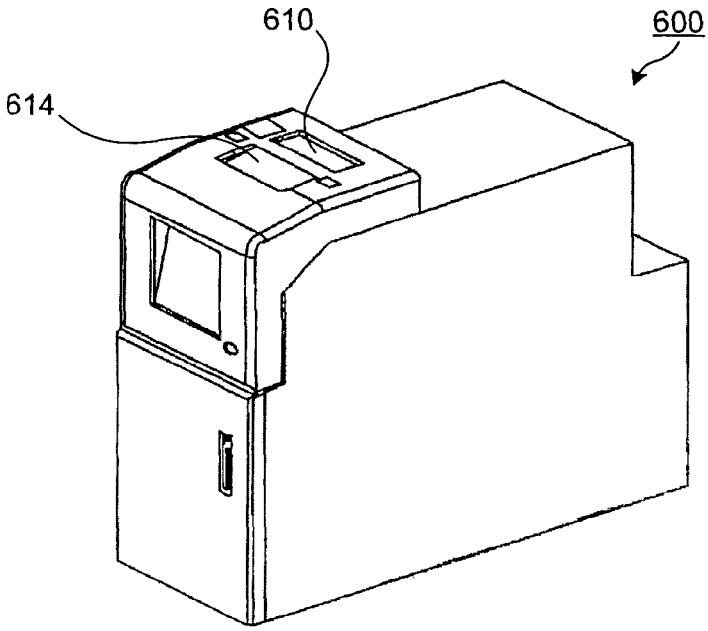
FIG. 9B is a perspective view of the circulation-type bill depositing and dispensing machine according to the fourth embodiment of the present invention.

FIGS. 9A and 9B depict a circulation-type bill depositing and dispensing machine 600 according to a fourth embodiment. FIG. 9A is a sectional view of a schematic configuration of the circulation-type bill depositing and dispensing machine 600, and FIG. 9B is a perspective view of the circulation-type bill depositing and dispensing machine 600. The circulation-type bill depositing and dispensing machine 600 according to the present embodiment has a function as the paper-sheet recognition apparatus of the present invention, and is mainly installed and used at banking institutions such as banks and post offices.

The circulation-type bill depositing and dispensing machine 600 according to the present embodiment includes, as shown in FIGS. 9A and 9B, a deposit port 610, a transport path 611, a recognition unit 612, a denomination-by-denomination storage/discharge unit 613 (denomination-by-denomination storage/discharge units 613*a*, 613*b*, 613*c*, 613*d*, 613*e*, and 613*f*), a withdrawal port 614, an escrow unit 616, and a reject box 617. The deposit port 610 receives the bills like the transaction port 21 in the bill depositing and dispensing machine 1 explained in the first embodiment.

The bill received by the deposit port 610 is fed and transported to the transport path 611 and passes through the recognition unit 612. The recognition unit 612 has the same function as that of the recognition/determination unit 25 explained in the first embodiment. However, in the present embodiment, a sensor unit 615 is formed on a part of the transport path 611 in the recognition unit 612. The sensor unit 615 has the same function as that of the sensor unit 23 explained in the first embodiment.

That is, the sensor unit 615 detects a feature amount indicating a shape of the bill, a feature amount indicating a magnetic content included in the bill, and a feature amount indicating a quantity or wavelength of the light transmitted through or reflected by the bill, as various security information (a feature amount in a specific part of the bill) such as the shape or image of the bill, and magnetism or a magnetic thread applied to the bill to prevent counterfeiting.

The recognition unit 612 recognizes whether the bill is genuine or counterfeit, and fit or unfit, based on a plurality of pieces of recognition security information of the bill detected by a plurality of sensors in the sensor unit 615 (the feature amount in a specific part of the bill) and a category classification table held in the recognition unit 612, to determine the category. The recognition unit 612 recognizes the denomination, authenticity, and fitness, and classifies the bills into five categories of genuine and fit bill (category 1), genuine and unfit bill (category 2), suspect bill that cannot be clearly determined as the genuine bill (category 3), counterfeit bill which is clearly different from the genuine bill and suspected as the counterfeit bill (category 4), and unrecognizable bill which is not a bill or cannot be recognized as the bill (rejected bill, category 5).

The bill having subjected to a recognition process of the denomination, authenticity, and fitness, and the category determination by the recognition unit 612 is transported to the withdrawal port 614 or the escrow unit 616 through the transport path 611 based on the category determination result. At this time, the bill categorized as the "unrecognizable bill" is transported to the withdrawal port 614 through the transport path 611 and returned to the user. Further, the bill categorized as the "counterfeit bill" is transported to the reject box 617 and collected through the transport path 611.

The bill categorized as the "suspect bill", the bill categorized as the "genuine and fit bill", and the bill categorized as the "genuine and unfit bill" are transported to the escrow unit 616 through the transport path 611 and held therein. The bills held in the escrow unit 616 passes through the recognition unit 612 through the transport path 611, and the denomination, authenticity, and fitness are recognized again, to determine the category. The bill categorized as the "suspect bill" is fed from the escrow unit 616 to the transport path 611, transported to the reject box 617 and collected.

The bill categorized as the "genuine and fit bill", and the bill categorized as the "genuine and unfit bill" are fed from the escrow unit 616 to the transport path 611, transported to the denomination-by-denomination storage/discharge unit 613, and collected in any one of the denomination-by-denomination storage/discharge units 613*a*, 613*b*, 613*c*, 613*d*, 613*e*, and 613*f* by fit bill or unfit bill and by denomination.

Further, at the time of withdrawal, the bills stored in the denomination-by-denomination storage/discharge unit 613 are fed to the transport path 611 one by one according to a requested amount. The bills transported to the transport path 611 passes through the recognition unit 612, where the denomination thereof is recognized, and transported to the withdrawal port 614 through the transport path 611, and given to the user.

Fifth Embodiment

An embodiment of setting the category classification pattern information in a bill processing apparatus such as the bill depositing and dispensing machine according to the first embodiment, the bill recognition/sort machine according to the second embodiment, the bill recognition/count machine according to the third embodiment, and the circulation-type bill depositing and dispensing machine according to the fourth embodiment is explained.

A manager having an authority to set the category classification pattern information operates the bill processing apparatus to select and set specification information of the category classification table. Specifically, the manager operates an operating unit of the bill processing apparatus to move on to a setting menu of country specification information, and selects and sets the country specification information. The bill processing apparatus refers to the category determination information of the specified country based on the category classification table to categorize bills of each denomination.

For example, if it is assumed that the country C is specified, the bill processing apparatus refers to the category classification table for fitness determination in FIG. 3C at the time of categorizing bills recognized as the genuine bills into fit bills and unfit bills, reads category determination information 4*b* of the country C, and determines that the bill is a genuine and unfit bill.

According to the invention, the feature amounts of a paper sheet is measured, and recognition of authenticity and fitness of the paper sheet is performed based on the feature amounts. The category of the recognized paper sheet is then determined by the recognition result and a plurality of pieces of different category classification pattern information prepared for each category for categorizing the paper sheets into a plurality of categories, which is obtained by combining the feature amounts. Accordingly, only by changing the category classification pattern information, which is a category determination criterion, a category determination of the paper sheet by the different category determination criterion can be supported promptly, easily, flexibly, and at a low cost.

According to the invention, the feature amounts includes a first feature amount indicating a shape of the paper sheet and a second feature amount indicating a quantity and wavelength of light transmitted through or reflected by the paper sheet as an optical feature amount to be measured optically, and also includes a third feature amount indicating a magnetic content included in the paper sheet as a magnetic feature amount to be measured magnetically. Accordingly, recognition of the authenticity and fitness of the paper sheet and category determination can be performed accurately based on the optical feature amount and the magnetic feature amount.

According to the invention, because the feature amount indicating an amount of the corner folding or missing part of the paper sheet is used as the first feature amount, recognition of the authenticity and fitness of the paper sheet and category determination can be performed accurately by the amount of the corner folding or missing part of the paper sheet as the feature amount.

According to the invention, because the attenuation of infrared ray transmitted through or reflected by the paper sheet is used as the second feature amount, recognition of the authenticity and fitness of the paper sheet and category determination can be accurately performed by the attenuation of the infrared ray transmitted through or reflected by the paper sheet as the feature amount.

According to the invention, because the feature amount indicating the magnetic content included in the serial-number printed portion, the portrait portion, and the amount-printed portion of the paper sheet is used as the third feature amount, recognition of the authenticity and fitness of the paper sheet and category determination can be accurately performed by the magnetic content included in the serial-number printed portion, the portrait portion, and the amount-printed portion of the paper sheet as the feature amount.

According to the invention, the paper sheet is a bill, and the bills are categorized into the first category corresponding to the genuine and fit bill, the second category corresponding to the genuine and unfit bill, the third category corresponding to the suspect bill that cannot be clearly determined as the genuine bill, the fourth category corresponding to the counterfeit bill, which is clearly different from the genuine bill and suspected as a counterfeit bill, and the fifth category corresponding to the unrecognizable bill that is not a bill or cannot be recognized as a bill. Accordingly, classification of the bills into five categories and the category determination of the paper sheet by the different category determination criterion can be supported promptly, easily, flexibly, and at a low cost only by changing the category classification pattern information, which is the category determination criterion.

According to the invention, the received bills are categorized into five categories by the category determining unit, and the bills classified as the fifth category is returned, whereas the bills classified as the first to fourth categories are stored in the storage unit. Accordingly, the bills in a specific category can be divided and sorted.

According to the invention, the category classification pattern information different for each country is specified to determine the category of the bill. Accordingly, the category determination of the paper sheets based on the category determination criteria in each country can be supported promptly, easily, flexibly, and at a low cost.

According to the invention, because the category classification pattern information is specified by the electronic terminal electrically connected to the apparatus itself, the flexibility in operability at the time of specifying the category classification pattern information is improved.

According to the invention, because the category classification pattern information is specified by the information input unit provided in the apparatus itself, the flexibility in operability at the time of specifying the category classification pattern information is improved.

According to the invention, the feature amounts a paper sheet is measured, authenticity and fitness of the paper sheet is recognized based on the feature amounts, and a category of the recognized paper sheet is determined using the recognition result and the plurality of pieces of different category classification pattern information prepared for each category for classifying the paper sheet into a plurality of categories, which is obtained by combining the feature amounts. Accordingly, the category determination of the paper sheet by the different category determination criterion can be supported promptly, easily, flexibly, and at a low cost only by changing the category classification pattern information, which is the category determination criterion.

According to the invention, the feature amounts includes a first feature amount indicating a shape of the paper sheet and a second feature amount indicating a quantity and wavelength of light transmitted through or reflected by the paper sheet as an optical feature amount to be measured optically, and also includes a third feature amount indicating a magnetic content included in the paper sheet as a magnetic feature amount to be measured magnetically. Accordingly, recognition of the authenticity and fitness of the paper sheet and the category determination can be performed accurately based on the feature amounts.

According to the invention, because the feature amount indicating an amount of the corner folding or missing part of the paper sheet is used as the first feature amount, recognition of the authenticity and fitness of the paper sheet and category determination can be accurately performed by the amount of the corner folding or missing part of the paper sheet as the feature amount.

According to the invention, because the attenuation of infrared ray transmitted through or reflected by the paper sheet is used as the second feature amount, recognition of the authenticity and fitness of the paper sheet and category determination can be accurately performed by the attenuation of the infrared ray transmitted through or reflected by the paper sheet as the feature amount.

According to the invention, because the feature amount indicating the magnetic content included in the serial-number printed portion, the portrait portion, and the amount-printed portion of the paper sheet is used as the third feature amount, recognition of the authenticity and fitness of the paper sheet and category determination can be accurately performed by the magnetic content included in the serial-number printed portion, the portrait portion, and the amount-printed portion of the paper sheet as the feature amount.

According to the invention, the paper sheet is a bill, and the bills are categorized into the first category corresponding to the genuine and fit bill, the second category corresponding to the genuine and unfit bill, the third category corresponding to the suspect bill that cannot be clearly determined as the genuine bill, the fourth category corresponding to the counterfeit bill, which is clearly different from the genuine bill and suspected as a counterfeit bill, and the fifth category corresponding to the unrecognizable bill that is not a bill or cannot be recognized as a bill. Accordingly, the category determination of the paper sheet by the different category determination criterion can be supported promptly, easily, flexibly, and at a low cost only by classifying the bills into five categories and changing the category classification pattern information, which is the category determination criterion.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper sheet recognition apparatus comprising:

a sensor that measures a plurality of feature amounts of a given paper sheet from a plurality of paper sheets;

a recognition unit that generates recognition result information related to whether the given paper sheet is genuine and fit, genuine and unfit, or counterfeit, based on the plurality of feature amounts;

a memory unit that stores therein selectable tables, each table having a plurality of pieces of category classification pattern information including criteria to determine at least one of authenticity and fitness of the given paper sheet, at least one of the selectable tables being previously defined; and a category determining unit that determines a category of the given paper sheet from a plurality of categories by comparison of the recognition result information from the recognition unit and the criteria included in one of the selectable tables selected by a user, wherein the category determining unit classifies the given paper sheet into one of the categories based on the comparison, the categories including unrecognizable, counterfeit, suspect, genuine and fit, and genuine and unfit.

2. The paper sheet recognition apparatus according to claim 1, wherein the memory unit stores specifying information, and wherein the category determining unit determines the category of the given paper sheet using criteria corresponding to the specifying information.

3. The paper sheet recognition apparatus according to claim 2, further comprising a communication interface configured to output bill information, and wherein the bill information includes denomination information and category information related to whether the given paper sheet is genuine and fit, genuine and unfit, counterfeit, suspect, or unrecognizable.

4. A paper sheet processing apparatus, comprising the paper sheet recognition apparatus according to claim 3.

5. The paper sheet recognition apparatus according to claim 2, wherein the memory unit stores at least one table of the plurality of pieces of category classification pattern information for one denomination.

6. A paper sheet processing apparatus, comprising the paper sheet recognition apparatus according to claim 5.

7. A paper sheet processing apparatus, comprising the paper sheet recognition apparatus according to claim 2.

8. The paper sheet recognition apparatus according to claim 1, further comprising a communication interface configured to output bill information, and wherein the bill information includes denomination information and category information related to whether the given paper sheet is genuine and fit, genuine and unfit, counterfeit, suspect, or unrecognizable.

9. The paper sheet recognition apparatus according to claim 8, wherein the memory unit stores at least one table of the plurality of pieces of category classification pattern information for one denomination.

10. A paper sheet processing apparatus, comprising the paper sheet recognition apparatus according to claim 9.

11. A paper sheet processing apparatus, comprising the paper sheet recognition apparatus according to claim 8.

12. The paper sheet recognition apparatus according to claim 1, wherein the memory unit stores at least one table of the plurality of pieces of category classification pattern information for one denomination.

13. A paper sheet processing apparatus, comprising the paper sheet recognition apparatus according to claim 12.

14. The paper sheet recognition apparatus according to claim 1, wherein a table of the plurality of pieces of category classification pattern information is selected by a country specifying information.

15. The paper sheet recognition apparatus according to claim 1, wherein at least one of the selectable tables comprises a first table having a first plurality of pieces of category classification pattern information including criteria to determine authenticity of the given paper sheet, and a second table having a second plurality of pieces of category classification pattern information including criteria to determine fitness of the given paper sheet; and wherein the category determining unit determines the category of the given paper sheet by comparison of the recognition result information from the recognition unit and the criteria included in the first and second tables.

16. A paper sheet recognition method comprising:

measuring a plurality of feature amounts of a given paper sheet from a plurality of paper sheets;

generating recognition result information related to whether the given paper sheet is genuine and fit, genuine and unfit, or counterfeit, based on the plurality of feature amounts;

reading a table, the table including a plurality of pieces of category classification pattern information including criteria to determine at least one of authenticity or fitness of the given paper sheet;

determining a category of the given paper sheet from a plurality of categories using the recognition result information generated in the generating step and the criteria included in the table read in the reading step; and setting respective different criteria for determining the recognition result information of the given paper sheet, wherein, in the determining, the given paper sheet is classified into one of the categories, the categories including unrecognizable, counterfeit, suspect, genuine and fit, and genuine and unfit.

17. A bill processing apparatus comprising:

a sensor that measures a plurality of feature amounts of a given bill from a plurality of bills;

a recognition unit that generates recognition result information related to whether the given bill is genuine and fit, genuine and unfit, or counterfeit based on the plurality of feature amounts;

a memory unit that stores therein selectable tables, at least one table having a plurality of pieces of category classification pattern information including criteria to determine at least one of authenticity or fitness of the given bill, at least one of the selectable tables being previously defined; and a category determining unit that determines a category of the given bill from a plurality of categories by comparison of the recognition result information from the recognition unit and the criteria included in one of the selectable tables selected by a user, wherein the category determining unit classifies the given bill into one of the categories based on the comparison, the categories including unrecognizable, counterfeit, suspect, genuine and fit, and genuine and unfit.

18. The bill processing apparatus according to claim 17, wherein at least one of the selectable tables comprises a first table having a first plurality of pieces of category classification pattern information including criteria to determine authenticity of the given bill, and a second table having a second plurality of pieces of category classification pattern information including criteria to determine fitness of the given bill; and wherein the category determining unit determines the category of the given bill by comparison of the recognition result information from the recognition unit and the criteria included in the first and second tables.

* * * * *